US008099028B2

(12) United States Patent
Yamada et al.

(10) Patent No.: US 8,099,028 B2
(45) Date of Patent: Jan. 17, 2012

(54) DEVELOPER SUPPLYING APPARATUS AND DEVELOPER SUPPLYING SYSTEM

(75) Inventors: Yusuke Yamada, Moriya (JP); Masafumi Takagi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 457 days.

(21) Appl. No.: 12/401,039

(22) Filed: Mar. 10, 2009

(65) Prior Publication Data

US 2009/0232546 A1 Sep. 17, 2009

(30) Foreign Application Priority Data

Mar. 13, 2008 (JP) ..... 2008-064249

(51) Int. Cl.
*G03G 15/08* (2006.01)

(52) U.S. Cl. ..... 399/262

(58) Field of Classification Search ..... 399/110, 399/119, 258, 262, 263
See application file for complete search history.

(56) References Cited

U.S. PATENT DOCUMENTS

| | | | |
|---|---|---|---|
| 5,842,962 | A | 12/1998 | Yamada et al. |
| 6,314,261 | B1 | 11/2001 | Omata et al. |
| 6,879,789 | B2 | 4/2005 | Yamada et al. |
| 6,920,298 | B2 | 7/2005 | Yamada et al. |
| 6,934,494 | B2 | 8/2005 | Yamada et al. |
| 6,944,417 | B2 | 9/2005 | Yamada et al. |
| 6,947,690 | B2 | 9/2005 | Tazawa et al. |
| 6,963,713 | B2 | 11/2005 | Isomura et al. |
| 6,971,421 | B2 | 12/2005 | Takagi |
| 6,980,754 | B2 | 12/2005 | Isomura et al. |
| 6,990,301 | B2 | 1/2006 | Yamada et al. |
| 6,993,273 | B2 | 1/2006 | Yamada |
| 7,039,347 | B2 | 5/2006 | Yamada et al. |
| 7,079,788 | B2 | 7/2006 | Ban et al. |
| 7,111,654 | B2 | 9/2006 | Takagi |
| 7,127,193 | B2 | 10/2006 | Yamada et al. |
| 7,155,138 | B2 | 12/2006 | Yamada |
| 7,190,925 | B2 | 3/2007 | Isomura et al. |
| 7,209,686 | B2 | 4/2007 | Yamada |

(Continued)

FOREIGN PATENT DOCUMENTS

JP 2002-318490 A 10/2002

*Primary Examiner* — David Gray
*Assistant Examiner* — Frederick Wenderoth
(74) *Attorney, Agent, or Firm* — Fitzpatrick, Cella, Harper & Scinto

(57) ABSTRACT

A developer supply system including a developer supply apparatus and a developer supply container which is detachably mountable to the apparatus, the system includes the developer supply container including a rotatable container body having an inner space configured and positioned to contain a developer; a feeding portion configured and positioned to feed the developer in the container body to discharge the developer out of the container body with a rotation of the container body; and a hooking portion configured and positioned to engage with the apparatus to receive a rotational force for rotating the container body; the apparatus including a driving member configured and positioned to apply the rotational force; a drive transmitting member configured and positioned to engage with the hooking portion to transmit the rotational force from the driving member to the hooking portion, the drive transmitting member, which has engaged with the hooking portion, being movable between a first position where the drive transmitting member and the driving member are engaged with each other and a second position where the drive transmitting member and the driving member are not engaged with each other; and a displacing member configured and positioned to displace the hooking portion to release an engagement between the hooking portion and the drive transmitting member which is in the second position.

5 Claims, 24 Drawing Sheets

U.S. PATENT DOCUMENTS

| | | | | |
|---|---|---|---|---|
| 7,324,777 | B2 | 1/2008 | Yamada et al. | |
| 7,376,369 | B2 | 5/2008 | Yamada et al. | |
| 7,382,997 | B2 | 6/2008 | Yamada et al. | |
| 7,386,251 | B2 | 6/2008 | Yamada et al. | |
| 7,391,999 | B2 | 6/2008 | Yamada | |
| 7,430,384 | B2 | 9/2008 | Yamada et al. | |
| 7,433,633 | B2 | 10/2008 | Yamada et al. | |
| 7,469,113 | B2 | 12/2008 | Yamada et al. | |
| 2005/0013635 | A1* | 1/2005 | Yamada | 399/258 |
| 2006/0133855 | A1* | 6/2006 | Yamada | 399/258 |
| 2009/0003872 | A1 | 1/2009 | Yamada et al. | |
| 2009/0154956 | A1 | 6/2009 | Yamada | |

* cited by examiner

DEVELOPER SUPPLYING APPARATUS AND DEVELOPER SUPPLYING SYSTEM

FIELD OF THE INVENTION AND RELATED ART

The present invention relates to a developer supplying apparatus and a developer supplying system, which are employed by image forming apparatuses such as an electrophotographic copying machine, an electrophotographic printer, an electrophotographic facsimile machine, an electrophotographic multifunction apparatus capable of performing the function of any of the preceding image forming apparatuses, etc.

An electrophotographic image forming apparatus such as an electrophotographic copying machine, an electrophotographic printer, etc., is structured so that as the developer (toner) in the main assembly of the image forming apparatus is consumed for image formation, the main assembly is replenished with the developer (toner) from a developer supply container (toner bottle).

More concretely, a toner bottle such as the above-mentioned one is mounted into, and kept in, the main assembly of an image forming apparatus. Further, a toner bottle and the image assembly of an image forming apparatus are designed so that as the developer in the main assembly is consumed, the main assembly is replenished little by little with the developer from the toner bottle.

As an example of a toner bottle such as the above-described one, the one disclosed in Patent Document 1 may be listed.

The toner bottle disclosed in this patent application, that is, Japanese Laid-open Patent Application 2002-318490 is designed so that it discharges the developer therein as it is rotated.

Further, for the purpose of improving this toner bottle in terms of operational efficiency this toner bottle is provided with a coupling mechanism of the so-called snap-hook type. It is also provided with a mechanism for disengaging the coupling mechanism of the snap-hook type.

However, it has become evident that the coupling mechanism of the snap-hook type, such as that of the above-mentioned toner bottle, sometimes fails to properly disengage, although the failure is very rare.

The inventors of the present invention thought that the cause of this failure was as follows:

Referring to FIG. 10, as a toner bottle 1 is rotated in the direction indicated by an arrow mark P in order to discharge the toner T therein, the substantial portion of the body of toner T in the toner bottle 1 shifts leftward. Incidentally, FIG. 10 is a phantom view of the toner bottle 1, as seen from the direction of its rotational axis shown in FIG. 11.

As the rotation of the toner bottle 1 in the direction P is stopped at the end of the operation for replenishing the main assembly of the image forming apparatus with the toner from the toner bottle 1 while the body of the toner T in the toner bottle 1 is in the above-mentioned state, force (torque) is generated in the direction indicated by an arrow mark R, by the weight of the body of the toner T itself, the substantial portion of which has shifted leftward. That is, the weight of the toner T in the toner bottle 1 works in the direction to rotate the toner bottle 1 in the opposite direction from the above-mentioned direction P. This force is significantly greater when the early stage of the usage of the toner bottle 1, that is, when the amount of the toner T remaining in the toner bottle 1 is larger.

It is reasonable to think that right after the rotation of the toner bottle for discharging the toner T therein is stopped, the snap-hook portion is under a load which works against the force applied to dissolve the engagement between the snap-hook portion 2 and a driving ring 3. Next, this load and the components affected by the load will be described in more detail with reference to FIG. 11, in which designated by alphanumeric referential codes 2*a*, 2*b*, 2*d* and 2*f* are a hook portion, a disengagement projection, a support portion, and a rigid portion, respectively, which are parts of the hook portion 2. Also referring to FIG. 11, designated by a referential number 3 is the driving ring, which is a part of the main assembly of the image forming apparatus.

FIG. 11 shows the state of the snap-hook portion 2 when it is under the above-mentioned load.

That is, the snap-hook portion 2 is under the weight of the toner T itself which works in the direction to rotate the toner bottle 1 in the direction indicated by arrow mark R, that is, the reverse direction. However, the driving ring 3, which is in engagement with the snap-hook portion 2, remains stationary. Therefore, the snap-hook portion 2 is under the load which works in the direction P. Thus, the snap-hook portion 2 remains twisted (by angle $\alpha$) in the circumferential direction of the toner bottle 1 as shown in FIG. 11.

As the snap-hook portion 2 remains twisted in the circumferential direction of the toner bottle 1, the supporting portion 2*d* remains sandwiched by the rigid portion 2*f* and driving ring 3 by a large amount of force, from the circumferential direction of the snap-hook portion 2. That is, the supporting portion 2*d* is kept in the state in which it is difficult for the supporting portion 2*d* to bend inward of the snap-hook portion 2 in terms of the radius direction of the snap-hook portion 2.

Thus, it becomes difficult to displace the support portion 2*d* inward of the snap-hook portion 2 in terms of the radius direction of the snap-hook portion 2, making it difficult to break the engagement between the snap-hook portion 2 and driving ring 3. It seems to be reasonable to the inventors of the present invention to think that this is the cause of the failed disengagement of the snap-hook portion 2.

As the above-described phenomenon occurs, it becomes difficult to remove the toner bottle from the main assembly of the image forming apparatus. Therefore, it is worth while improving the snap-hook portion 2*d* of the toner bottle 1, and the counterparts on the main assembly side of the image forming apparatus.

SUMMARY OF THE INVENTION

Accordingly, it is an object of the present invention to provide a system and an apparatus wherein engagement and disengagement between a hooking portion of a developer supply container and a drive transmitting member of a developer supplying device.

According to an aspect of the present invention, there is provided a developer supply system including a developer supply apparatus and a developer supply container which is detachably mountable to said developer supply apparatus, said developer supply system comprising:

said developer supply container including a rotatable container body having an inner space configured and positioned to contain a developer;

a feeding portion configured and positioned to feed the developer in said container body to discharge the developer out of said container body with a rotation of said container body; and a hooking portion configured and positioned to engage with said developer supply apparatus to receive a rotational force for rotating said container body;

said developer supply apparatus including a driving member configured and positioned to apply the rotational force; a drive transmitting member configured and positioned to engage with said hooking portion to transmit the rotational force from said driving member to said hooking portion, said drive transmitting member, which has engaged with said hooking portion, being movable between a first position where said drive transmitting member and said driving member are engaged with each other and a second position where said drive transmitting member and said driving member are not engaged with each other; and a displacing member configured and positioned to displace said hooking portion to release an engagement between said hooking portion and said drive transmitting member which is in the second position.

According to another aspect of the present invention, there is provided a developer supply apparatus supplied a developer from a developer supply container including a rotatable container body having an inner space configured and positioned to contain a developer, a feeding portion configured and positioned to feed the developer in said container body to discharge the developer out of said container body with a rotation of said container body, and a hooking portion configured and positioned to engage with said developer supply apparatus to receive a rotational force for rotating said container body, said developer supply apparatus comprising a driving member configured and positioned to apply the rotational force; a drive transmitting member configured and positioned to engage with said hooking portion to transmit the rotational force from said driving member to said hooking portion, said drive transmitting member, which has engaged with said hooking portion, being movable between a first position where said drive transmitting member and said driving member are engaged with each other and a second position where said drive transmitting member and said driving member are not engaged with each other; and a displacing member configured and positioned to displace said hooking portion to release an engagement between said hooking portion and said drive transmitting member which is in the second position.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 4(A) is a perspective view of the toner bottle when the toner bottle has just been placed in the bottle tray; FIG. 4(B) is a perspective view of the toner bottle when the coupling portion of the toner bottle has just been engaged with the toner bottle driving mechanism of the main assembly; and FIG. 4(C) is a perspective view of the toner bottle when the sealing member has just been disengaged from the toner bottle (toner bottle has just been unsealed) by slightly retracting the toner bottle.

FIG. 17(A) is a side view of the toner bottle when the toner bottle has just been placed in the bottle tray; FIG. 17(B) is a side view of the toner bottle when the coupling portion of the toner bottle has just been engaged with the toner bottle driving mechanism of the main assembly; and FIG. 17(C) is a side view of the toner bottle when the sealing member has just been disengaged from the toner bottle (toner bottle has just been unsealed) by slightly retracting the toner bottle.

DETAILED DESCRIPTION OF THE PREFERRED EMBODIMENTS

Hereinafter, the preferred embodiments of the present invention will be described in detail with reference to the appended drawings. However, the preferred embodiments are not intended to limit the present invention in scope, unless specifically noted. That is, the measurements, materials, and shapes of the structural components of the toner bottles, and those of the toner supplying apparatus, the positional relationship among these components, should be modified as necessary according to the structure of the main assembly of an image forming apparatus, and also, various factors which affect the operation of the image forming apparatus.

Embodiment 1

First, a typical electrophotographic image forming apparatus, more concretely, an electrophotographic copying machine, which employs one of the developer supplying system in accordance with the present invention will be described regarding its structure.

(Image Forming Portion)

Figure 1:
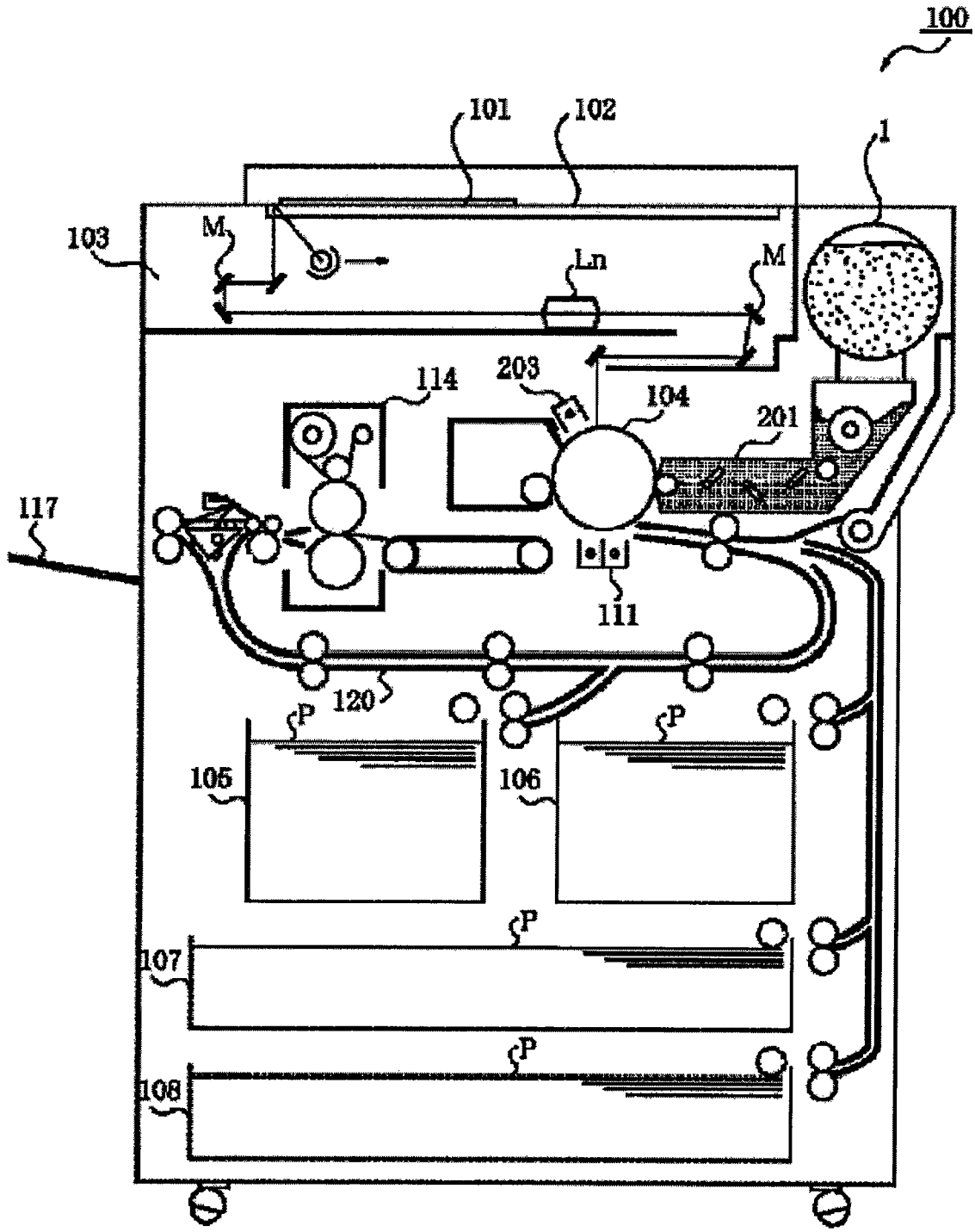
FIG. 1 is a vertical sectional view of a typical image forming apparatus, showing the general structure thereof.
Figure 2:
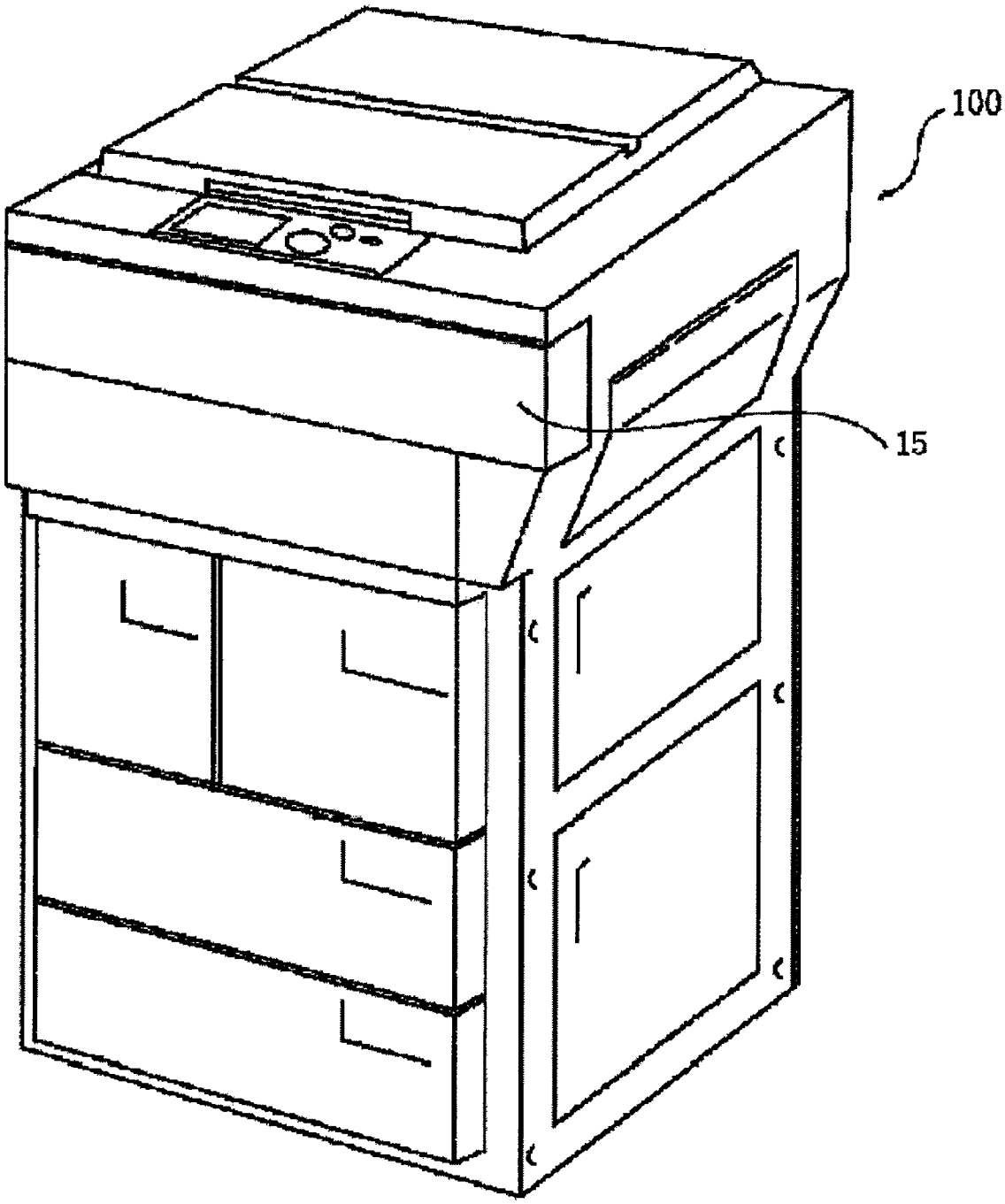
FIG. 2 is a perspective view of the image forming apparatus shown in FIG. 1.

FIG. 1 is a sectional view of the typical electrophotographic copying machine 100 (which hereafter may be referred to as apparatus main assembly 100). FIG. 2 is an external perspective view of the copying machine 100. Next, the image forming portion of this copying machine will be described.

An original placement platen 102 is where an original 101, that is, an object whose image is to be formed, is placed. After the original 100 is set on the original placement platen 102, it is illuminated by the light projected onto the original 100 from a light source. The light reflected by the original 101 is focused on the uniformly charged portion of the peripheral surface of a photosensitive member 104 (which hereafter may be referred to as photosensitive drum). As a result, an image of the original 101 is formed on the uniformly charged portion of the peripheral surface of the photosensitive drum 104. More specifically, the peripheral surface of the photosensitive drum 104 is uniformly charged by a primary charging device 203. Thus, as the image of the original 101 is formed on the uniformly charged portion of the peripheral surface of the photosensitive drum 104, an electrophotographic latent image is effected on the uniformly charged portion of the peripheral surface of the photosensitive drum 104. This electrostatic latent image on the photosensitive drum 104 is developed into a visible image, that is, an image formed of toner, with the use of a developing device 201 which uses toner as developer.

Meanwhile, sheets of recording paper are sequentially fed into the main assembly of the image forming apparatus, and then, are sent with a preset timing to the photosensitive drum 104 from one of the recording sheet cassettes 105, 106, 107, and 108, in which sheets of recording paper P are stored. Then, a toner image is transferred from the photosensitive drum 104 by a transfer charging device 111 onto each of the sent recording paper P. Then, each recording sheet P is conveyed to a fixing device 114, in which the toner image on the recording sheet P is fixed to the recording sheet P with heat and pressure. Then, each recording sheet P is discharged into a delivery tray 117.

Given above is the description of the image formation sequence of the image forming apparatus in this embodiment. The toner in the developing device 201 is consumed by the image formation. Thus, the image forming apparatus in this embodiment is structured so that the developing device 201 is replenished with the toner from a toner bottle as a developer supply container.

(Toner Supplying Apparatus)

Next, a toner supplying apparatus, that is, a developer supplying apparatus, will be described. The toner supplying apparatus in this embodiment is structured so that a toner bottle can be removably (exchangeably) mounted therein, and also, bears the role of transmitting rotational driving force to a toner bottle, as a developer supply container, by being connected to the toner bottle in such a manner that the toner bottle can be driven by the toner supplying apparatus.

More concretely, the toner supplying apparatus is provided with a chamber (toner bottle chamber) in which the toner bottle is mounted, and a driving mechanism 20, which is positioned in the toner bottle chamber 1 to rotationally drive the toner bottle 1. As the toner bottle 1 is mounted into the toner bottle chamber, it is connected to the driving mechanism 20. The toner supplying apparatus is also provided with a toner bottle disengaging mechanism 300 for disengaging the toner bottle 1 from the driving mechanism 20.

Figure 3:
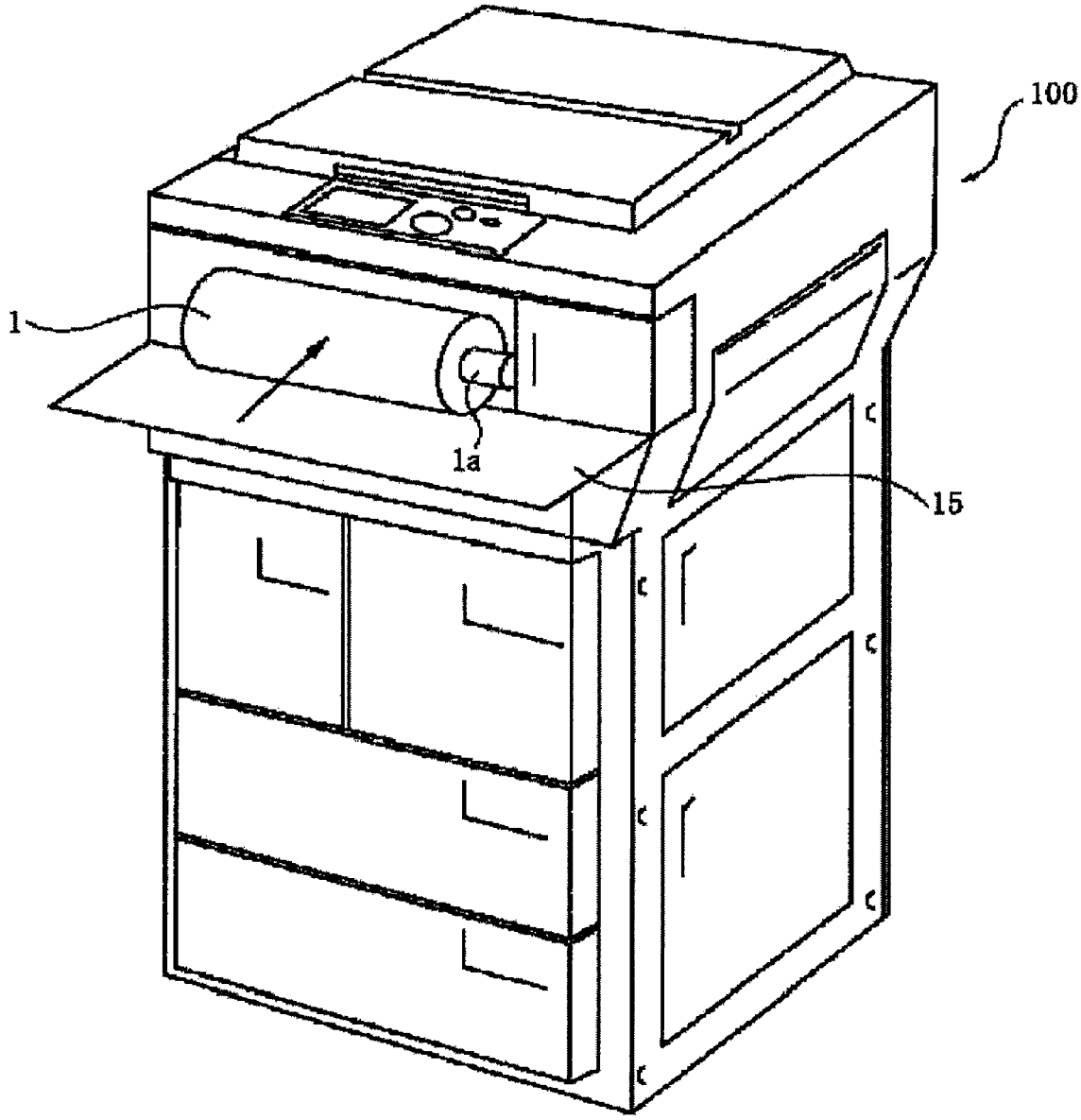
FIG. 3 is a perspective view of the image forming apparatus shown in FIGS. 1 and 2, when its toner bottle replacement cover is open, and a toner supply container is being mounted into the main assembly of the image forming apparatus.
Figure 5:
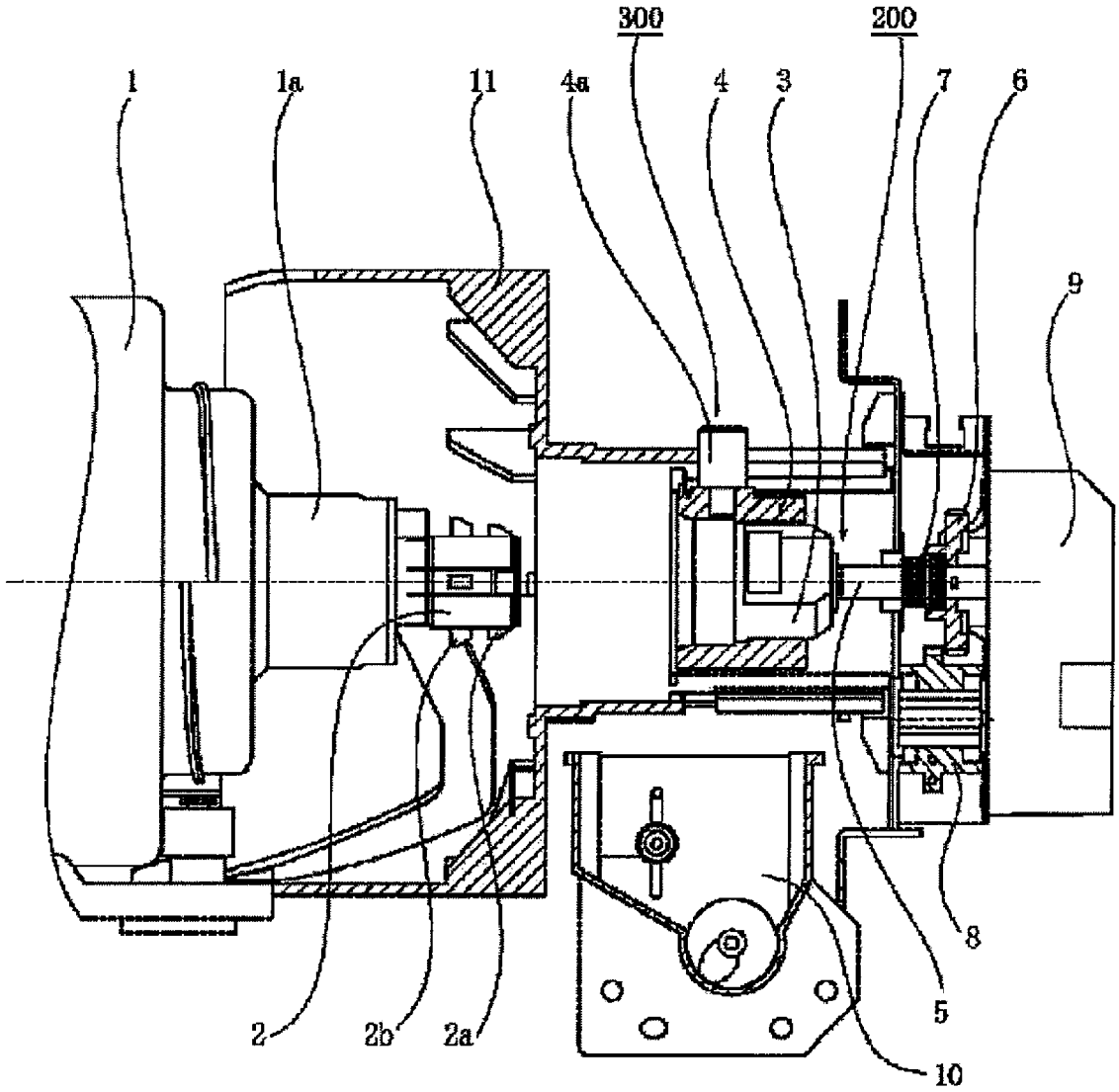
FIG. 5 is a combination of the side view of the toner releasing end portion of the toner bottle 1, and the sectional view of the toner receiving portion of the image forming apparatus (toner supplying apparatus), at a plane coinciding with the axial line of the toner receiving portion, when the toner bottle 1 and toner receiving portion are in the condition shown in FIG. 4(A).

First, the toner bottle chamber will be described. Referring to FIG. 3, as a cover 15 of the toner bottle chamber is opened, a bottle tray 50 (bottle holder) is exposed, which functions as the toner bottle holder of the toner supplying apparatus. Not only is the bottle tray 50 for holding the toner bottle 1, but also, for correctly positioning the toner bottle 1. More specifically, a user places the toner bottle 1 on the bottle tray 50 so that the toner outlet side 1*a* of the toner bottle 1 faces the driving mechanism 200 (FIG. 5). Then, the user rotates a lever 11. As the lever 11 is rotated, the toner bottle 1 is properly positioned (set) relative to the bottle tray 50. More specifically, the main assembly of the image forming apparatus is structured so that as the lever 11 is rotationally moved, the bottle tray 50 slides in the direction parallel with the rotational axis of the toner bottle 1 (toner conveyance direction), while holding the toner bottle 1, as will be described later.

The above-mentioned mechanism for sliding the bottle tray 50 is structured as follows.

Figure 4:
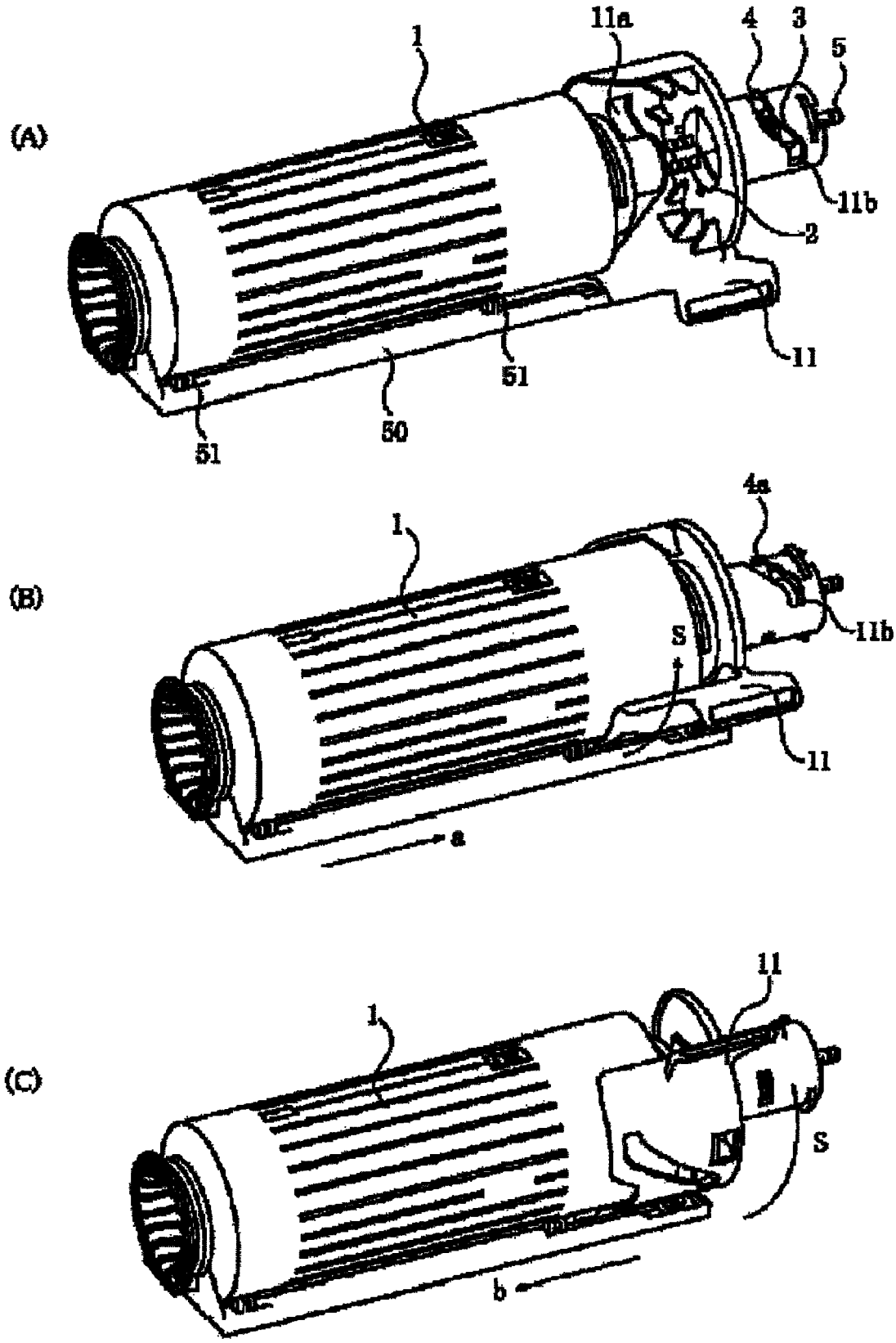
FIG. 4 is a drawing for describing the operation for setting the toner bottle in the main assembly of the image forming apparatus.

Referring to FIG. 4, the bottle tray 50 is provided with multiple rollers 51, which support the toner bottle 1 so that the toner bottle 1 is rotatable while it is rested on the rollers 51. As for the toner bottle 1, it is structured so that it easily rotates, while being supported by the bottle supporting rollers 51, when supplying the developing device 201 with the toner from the toner bottle 1.

Further, the bottle tray 30 is provided with the above-mentioned lever 11 for controlling the toner bottle 1. The lever 11 is a part of a roughly cylindrical connective portion of the toner supplying apparatus. The lever 11 is to be operated by a user. The connective portion is provided with a cam groove 11*a* for advancing (a direction indicated by reference character a (also referred to hereinafter as "direction indicated by arrow mark a" and "direction a") in FIG. 4) or retracting (a direction indicated by reference character b (also referred to hereinafter as "direction indicated by arrow mark b" and "direction b") in FIG. 4) the bottle tray 50 in the direction parallel with the rotational axis of the toner bottle 1. Further, the connective portion is provided with a cam groove 11*b* for advancing (the direction indicated by reference character a in FIG. 4) or retracting (the direction indicated by reference character b in FIG. 4) a disengagement ring 4 in the direction parallel with the rotational axis of the toner bottle 1.

In other words, the toner supplying apparatus is structured so that as the lever 11 is rotationally moved as described above, the bottle tray 50 and disengagement ring 4 advances or retracts in the directions a and b, respectively.

Next, the driving mechanism 20 will be described. Referring to FIG. 5, the toner supplying apparatus (apparatus main assembly) is provided with the driving mechanism, which is on the right-hand side (in the drawing), that is, frontward side in terms of a toner bottle mounting direction of the toner bottle chamber.

The driving mechanism 200 is provided with a motor 9, and a motor gear 8 connected to the motor 9 as a driving member. The driving mechanism 200 is also provided with a driving force transmitting member, which is connectable to the motor gear 8 to drive the toner bottle 1.

The driving force transmitting member has: a drive shaft 5; a driving gear 6 connectable with the motor gear 8; and a drive ring 3, which is in the form of a hollow cylinder, and is engageable with the toner bottle 1. The drive shaft 5, driving gear 6, and drive ring 3 are integral parts of a single component, and are supported so that they can be slidingly moved in the direction parallel with the rotational axis of the toner bottle 1 (the direction a as well as the direction b in FIG. 4).

Referring to FIG. 8(C), the drive ring 3 is provided with a center hole, in which the hook portions 2*a* of the coupling portion 2 of the toner bottle 1 are inserted. It also has: a pair of holes 3*a*, in which the hook portions 2*a* of the toner bottle 1 fit; and a pair of ribs 3*b*, which are provided for transmitting rotational force to the hook portion 2*a* in the holes 3*a*. In this embodiment, the two rib portions 2*a* are positioned so that they are apart from each other by 180° in terms of the rotational direction of the toner bottle 1; the portions between the two rib portions 2*a*, in terms of the rotational direction of the toner bottle 1, are the pair of holes 3*a*.

The driving force transmitting member is kept pressed by a spring 7 (as a pressure generating member) in the downstream direction (rightward in FIG. 4) in terms of the direction in which the toner bottle 1 is mounted into the toner supplying apparatus (apparatus main assembly).

Therefore, when the toner bottle 1 is not in the toner bottle chamber, the driving gear 6 of the driving force transmitting member remains disengaged from the motor gear 8 (as shown in FIG. 5).

Figure 7:
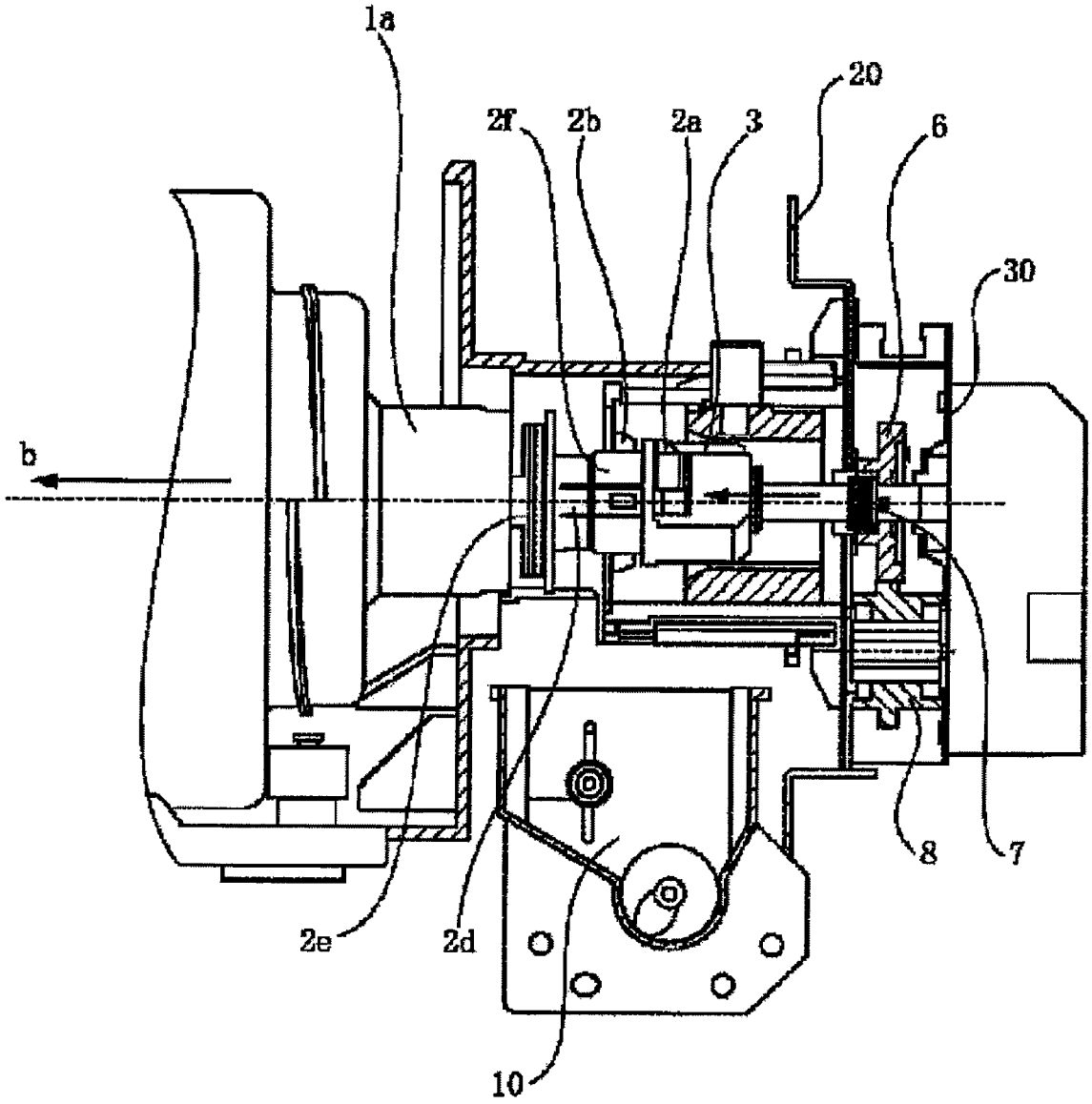
FIG. 7 is a combination of the side view of the toner releasing end portion of the toner bottle 1, and the sectional view of the toner receiving portion of the image forming apparatus (toner supplying apparatus), at a plane coinciding with the axial line of the toner receiving portion, when the toner bottle 1 and toner receiving portion are in the condition shown in FIG. 4(C).

On the other hand, as the lever 11 is operated, the driving force transmitting member slides toward the toner bottle 1, that is, in the direction indicated by the arrow mark a in FIG. 4, and engages with the hook portions 2*a*. Then, it slides with the toner bottle 1 in the direction indicated by the arrow mark b in FIG. 4. As a result, the driving gear 6 of the driving force transmitting member engages with the motor gear 8 (as shown in FIG. 7).

The motor 9 is started while the driving force transmitting member and motor gear 8 are in the above-described state. As the motor 9 is started, the driving force from the motor 9 is sequentially transmitted from the motor gear 8 to the driving gear 6, drive shaft 5, and drive ring 3 in the order in which they are listed. Lastly, the driving force is transmitted from the hook portions 2*a* to the toner bottle 1.

Next, the disengaging mechanism 300 will be described. Referring to FIG. 5, the disengaging mechanism 300 has: a release ring 4 as a pressing member (releasing member); and a boss 4*a*, which engages with the cam groove 11*a* (FIG. 4), with which the release ring 4 is provided. The release ring 4 is in the form of a hollow cylinder, and is fitted around the driver ring 3 so that it can be slid relative to the drive ring 3.

The toner supplying apparatus is structured so that as the lever 11 is rotationally moved, the release ring 4 advances or retreats relative to the toner bottle 1. Next, referring to FIG. 13, the release ring 4 is structured so that as the release ring 4 is slid relative to the drive ring 3, the inward surface of the release ring 4 presses the release projections 2*b* of the coupling portion 2 of the toner bottle 1, toward the axial line (centerline) of the coupling portion 2. Thus, the hook portions 2*a* of the coupling portion 2 can be moved out of the holes 3*a* of the driving ring 3 by retracting the coupling portion 2 from the driving ring 3 while keeping the release projections 2*b* of the coupling portion 2 pressed by the release ring 4.

In this embodiment, therefore, the hook portions 2*a* of the toner bottle 1 can be easily disengaged from the drive ring 3 of the toner supplying apparatus (apparatus main assembly) without damaging these components (members). That is, because of the structural arrangement described above, the toner supplying system in this embodiment is very reliable.

Next, referring to FIG. 5, the toner supplying apparatus in this embodiment is provided with a sub-hopper 10, which temporarily stores the toner as the toner is discharged from the toner bottle 1. That is, the toner discharged from the toner bottle 1 is temporarily stored in the sub-hopper 10, and then, is conveyed, as necessary, to the developing device 201 by the toner conveyance screw in the sub-hopper 10.

(Structure of Toner Bottle)

Next, referring to FIGS. 8(A) and 8(B), the toner bottle 1, that is, the toner supply container will be described. FIG. 8(C) is an enlarged view of the above-mentioned drive ring 3.

Referring to FIGS. 8(A) and 8(B), the developer storage portion (which hereafter may be referred to as container proper), which is the essential portion of the toner bottle 1, is in the form of a hollow cylinder. The toner bottle 1 has another cylindrical portion 1*a*, which is smaller in external diameter than that of the container proper. The cylindrical portion 1*a* projects from one of the lengthwise ends of the container proper. Before the toner bottle 1 is used for the first time, there is a preset amount of toner (as developer) in the developer storage portion (container proper) of the toner bottle 1. The lengthwise end of the cylindrical portion 1*a*, which is on the opposite side from the container proper, is provided with a hole (toner outlet), through which the toner is discharged.

This hole of the cylindrical portion 1*a* remains sealed with a sealing portion 2*e*, with which the coupling portion 2 is provided. The sealing portion 2 is pressed into the hole of the cylindrical portion 1*a* to keep the toner bottle 1 sealed.

Figure 8:
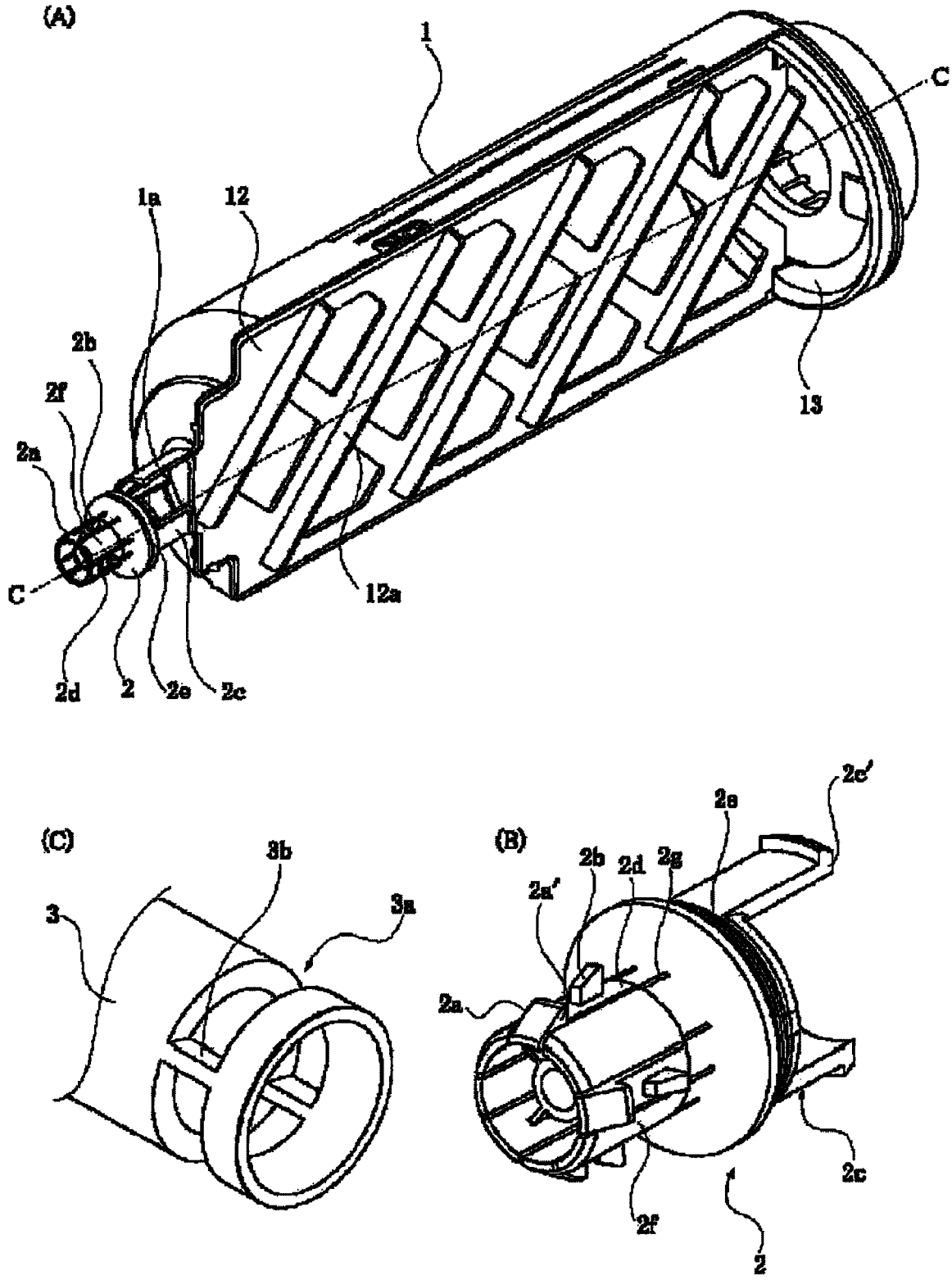
FIG. 8(A) is a partially broken perspective view of the toner bottle, showing the general structure of the toner bottle.
FIG. 8(B) is an enlarged perspective view of the coupling portion of the toner bottle.
FIG. 8(C) is an enlarged perspective view of the driving ring.
Figure 9:
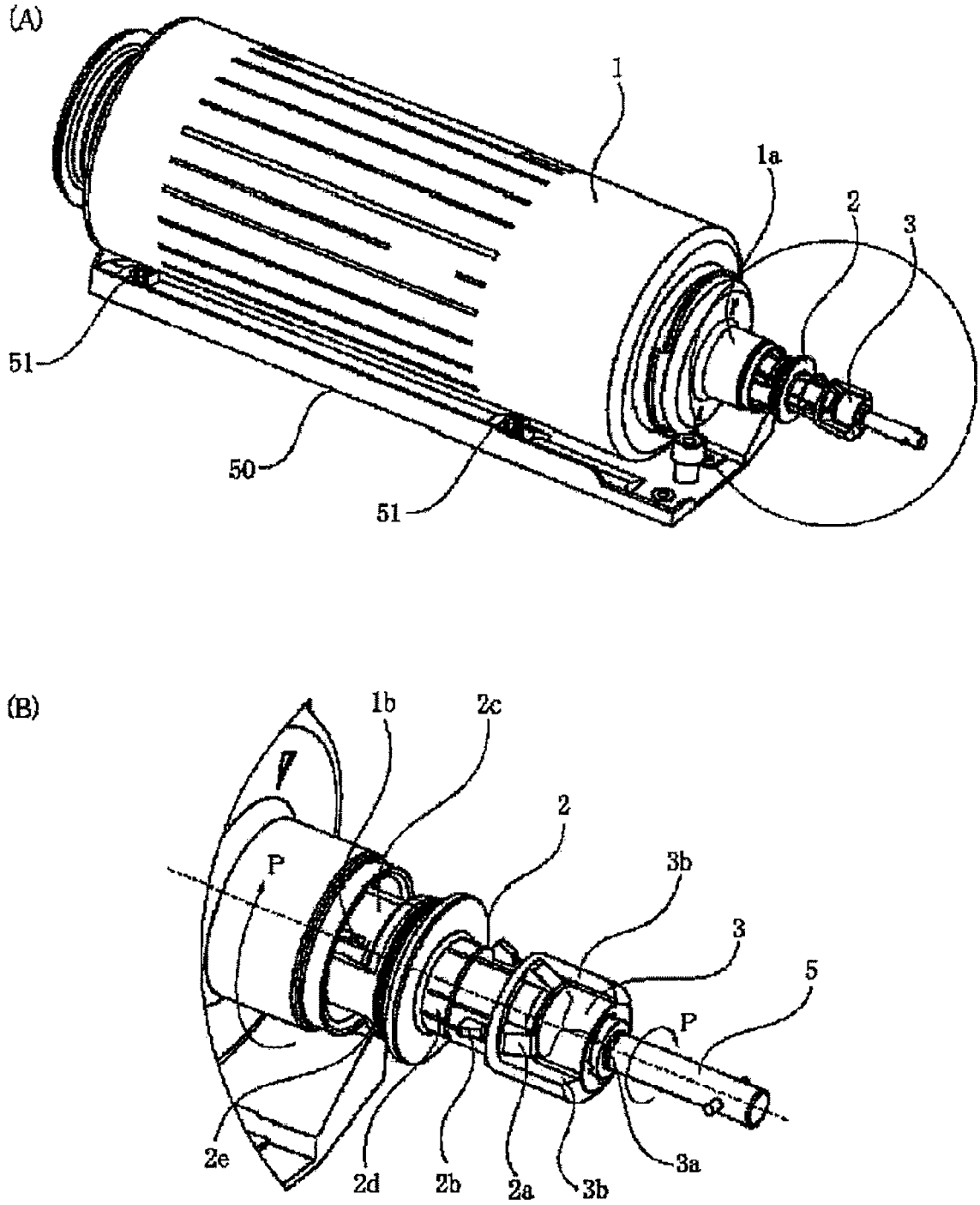
FIG. 9(A) is a perspective view of the toner bottle when it is being rotated (unsealed)
FIG. 9(B) is an enlarged perspective view of the toner releasing end portion of the toner bottle and the toner bottle driving portion of the toner supplying apparatus, when they are being rotated.
Figure 10:
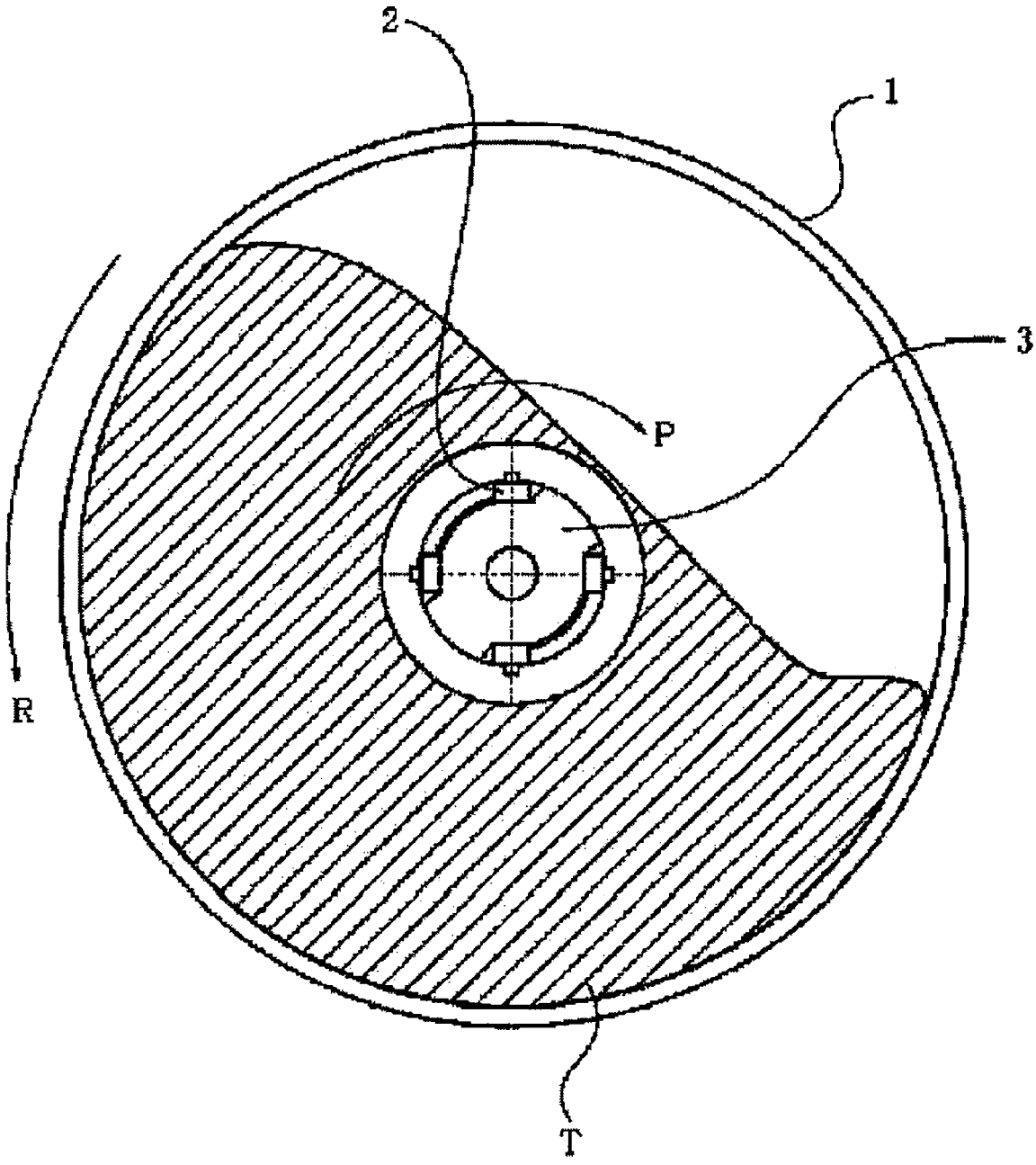
FIG. 10 is a cross-sectional view of the toner bottle, showing the interior of the toner bottle while the toner bottle is rotated.

The hole (toner outlet) of the cylindrical portion 1*a* can be opened by moving the container proper and coupling portion 2 (sealing portion 2*e*) of the toner bottle 1 relative to each other in the axial line of the toner bottle 1 (direction C-C in FIG. 8). The hole (toner outlet) of the toner bottle 1 in this embodiment can be unsealed by sliding the container proper of the toner bottle 1 in the direction indicated by the arrow mark b in FIG. 4 (upstream in terms of toner conveyance direction), relative to the coupling portion 2 (sealing portion 2*e*), by rotating the above-mentioned lever 11, after the toner bottle 1 is properly set in the bottle tray 50.

On the other hand, all that is necessary to do to reseal the toner outlet (hole) of the cylindrical portion 1*a* is to rotationally move the lever 11 in the opposite direction from the direction in which the lever 11 is rotated to unseal the toner outlet (hole). That is, as the lever 11 is rotationally moved in the opposite direction, the toner bottle 1 is slid relative to the coupling portion 2 (sealing portion 2*e*) in the direction indicated by the arrow mark a, and therefore, the toner outlet is resealed.

Further, the coupling portion 2 is provided with the hook portions 2*a* (which may be referred to as engagement projections), which fit into the holes 3*a* of the driver ring 3 of the toner supplying apparatus. The coupling portion 2 is also provided with supporting portions 2*d* for supporting the hook portions 2*a* in such a manner that the hook portions 2*d* are allowed to displace inward of the coupling portion 2 in terms of the radius direction of the coupling portion 2.

The supporting portions 2*d* are made of an elastic resin, being enabled to displace inward of the coupling 2 in terms of the radius direction of the coupling 2. The coupling portion 2 is kept coupled with the driving ring 3 with the use of the resiliency of the supporting portions 2*d*. That is, the coupling portion 2 is structured so that it snap-fits with the driving ring 3. Further, the supporting portions 2*d* are provided with release projections 2*b*, one for one, as the means for uncoupling the coupling portion 2 from the driving ring 3. Each of the release projections 2*b* is on the developer storage side of the corresponding hook portion 2*a*.

The supporting portions 2*d* may be structured as follows. To describe concretely, the supporting portions 2*d* themselves may be formed of a highly rigid material, and are kept pressed outward of the coupling portion 2, in terms of the radius direction of the coupling portion 2, by springs. This structural arrangement can also provide the supporting portions 2*d* with the same function as the one with which the supporting portion 2*d* in this embodiment is provided.

Referring to FIG. 8(B), the hook portion 2*a* and release portion 2*b* are in the form of a projection which project outward, in terms of the radius direction of the coupling portion 2, from the corresponding supporting portion 2*d*. Further, the coupling portion 2 is structured so that the release portions 2*b* project farther outward than the hook portions 2*d*, in terms of the radius direction of the coupling portion 2.

In this embodiment, the coupling portion 2 is provided with four hook portions 2*a*, which are positioned with 90° intervals in terms of the circumferential direction of the coupling portion 2, and four release projections 2*b*, which also are positioned with 90° intervals in terms of the circumferential direction of the coupling portion 2.

Further, the coupling portion 2 is provided with four rigid portions 2*f*, which correspond in position to the above-mentioned intervals of the supporting portions 2*d* (intervals of hook portion 2*a*, and intervals of the release portion 2*b*), in terms of the circumferential direction of the coupling portion 2. In order to make it easier for the supporting portion 2*d* to flex, there is provided a slit 2*g* between each rigid portion 2*f* and the next supporting portion 2*d*. In normal usage, the rigid portions 2*f* do not deform inward of the coupling portion 2 in terms of the radius direction of the coupling portion 2, and play the role of protecting the supporting portions 2*d*.

That is, the coupling portion 2 and driving ring 3 are structured so that as the coupling portion 2 is moved into the driving ring 3 in the direction parallel with the rotational axis of the toner bottle 1 (direction C-C in FIG. 8), the hook portions 2*a* temporarily overlap with the driving ring 3 in terms of their radius directions, being thereby temporarily displaced inward of their radius directions by the driving ring 3, and then, as the coupling portion 2 is moved further into the driving ring 3, the hook portions 2*a* displace themselves outward of the coupling portion 2 (driving ring 3) in terms of the radius direction of the coupling portion 2, and fit into the holes 3*a* of the driving ring 3. When the coupling portion 2 is in engagement with the driving ring 3, that is, when the hook portions 2*a* are perfectly in the holes 3*a* of the driving ring 3, the connection between the coupling portion 2 and driving ring 3 is very strong, and therefore, it virtually never occurs that the coupling portion 2 and driving ring 3 become disengaged from each other during the operational step for unsealing the toner bottle 1, which follows the operational step for engaging (coupling) the coupling portion 2 with the driving ring 3.

Further, the coupling portion 2 is provided with a pair of claws 2*c* as driving force transmitting portions. More specifically, the rotational driving force receiving portion 2*a*' of the hook portion 2*a* receives the rotational driving force from the corresponding rib portion 3*b* of the driving ring 3, and the two claws 2*c* transmit this rotational driving force to the container proper of the toner bottle 1. The two claws 2*c* are positioned 180° apart. Each claw 2*c* is provided with a portion 2*c*, which engages with the corresponding projection, which projects inward from the inward surface of the aforementioned cylindrical portion 1*a*.

Next, the toner conveying mechanism of the toner bottle 1 will be described. The interior of the toner bottle 1 is provided with a baffling plate 12 as a toner conveying portion. The baffling plate 12 extends from one lengthwise end of the toner bottle 1 to the other in a manner to partition in half the internal space of the toner bottle 1.

The baffling plate 12 is solidly attached to the container proper so that it does not rotate relative to the container proper. In other words, it is attached to the container proper so that it rotates with the container proper. The baffling plate 12 is provided with multiple toner conveyance guides 12*a*, which are tilted toward the cylindrical portion 1*a* relative to the rotational axis C-C of the toner bottle 1. Among these toner conveyance guides 12*a*, the closest one to the cylindrical portion 1*a* is positioned so that one of its lengthwise ends is in contact with the upstream end of the cylindrical portion 1*a* in terms of the toner conveyance direction.

The toner conveyance guides 12*a* are on both of the primary surfaces of the baffling plate 12. The set of the toner conveyance guides 12*a*, which is on one of the primary surfaces of the baffling plate 12, and the other set of the toner conveyance guides 12*a*, which is on the other primary surface of the baffling plate, are symmetrically positioned relative to each other, with reference to the rotational axis of the toner bottle 1, so that as the container proper is rotated in the preset direction, the toner in the container proper is conveyed toward the cylindrical portion 1*a*. That is, each time the baffling plate 12 rotates 180 degrees with the toner bottle 1, the toner is lifted up by the toner conveyance guides 12*a*, and then, slides down on the toner conveyance guides 12*a*. Thus, the toner is efficiently conveyed to be discharged from the toner bottle 1.

Further, the baffling plate 12 is provided with multiple through holes, each of which is located between the adjacent two toner conveyance guides 12*a*. Not only do these through holes allow the toner to move back and forth between the two spaces partitioned by the baffling plate 12, but also, efficiently stirs the toner by allowing the toner to fall after being lifted by the baffling plate 12.

(Method for Replacing Toner Bottle)

Next, the method for replacing the toner bottle 1 will be described, with reference to FIG. 3, which shows the toner bottle 1, which is being mounted into the main assembly of the copying machine.

Designated by a referential number 15 is a bottle replacement cover, which is dedicated to the mounting or dismounting of the toner bottle 1 (replacing toner bottle in apparatus main assembly with another toner bottle). That is, the bottle replacement cover 1 is such a cover that is to be opened and closed only for mounting or removing the toner bottle 1. The main assembly of the copy machine is structured so that as the bottle replacement cover 15 is opened, a bottle tray 50 appears.

Figure 6:
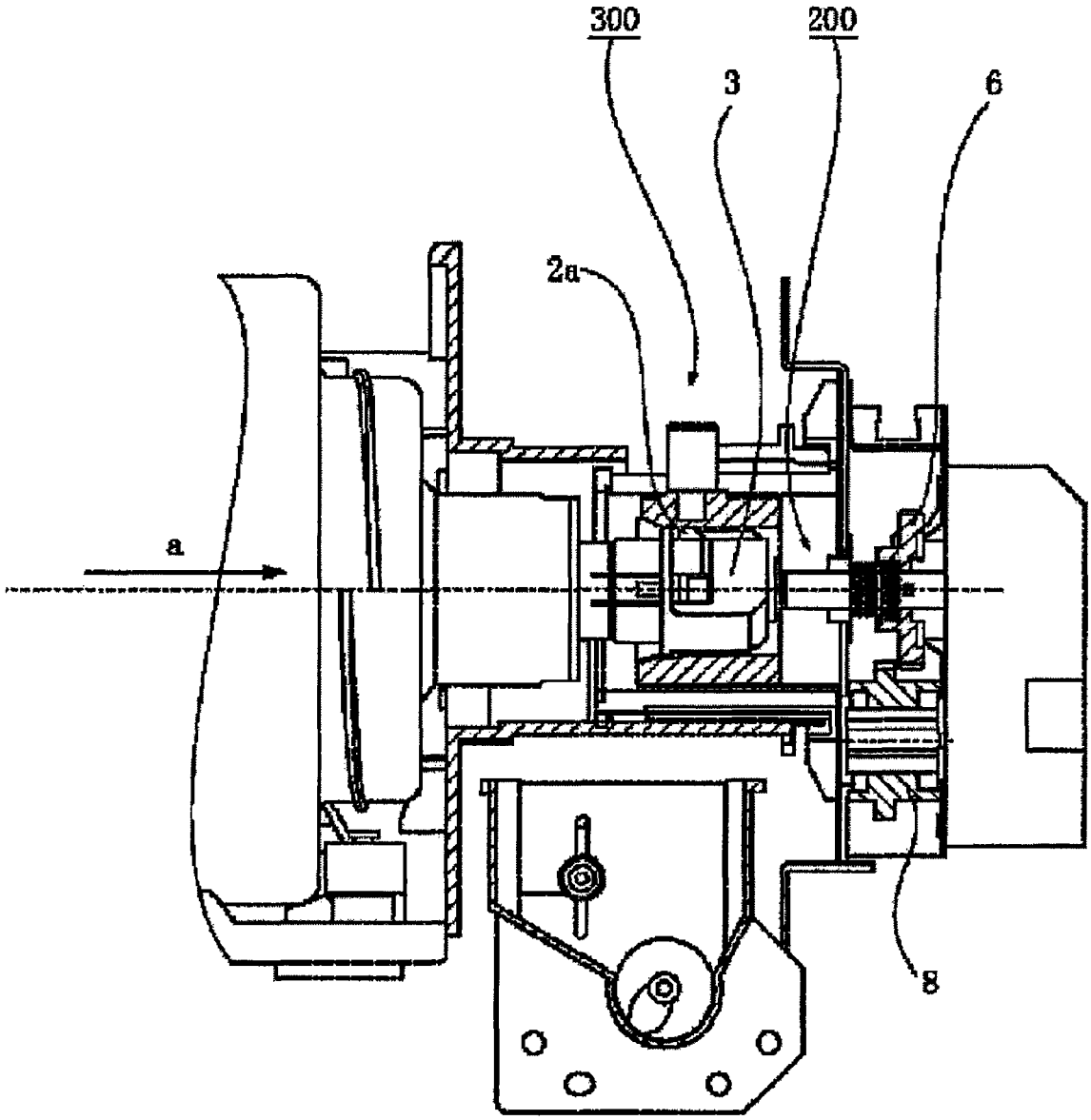
FIG. 6 is a combination of the side view of the toner releasing end portion of the toner bottle 1, and the sectional view of the toner receiving portion of the image forming apparatus (toner supplying apparatus), at a plane coinciding with the axial line of the toner receiving portion, when the toner bottle 1 and toner receiving portion are in the condition shown in FIG. 4(B).

Next, referring to FIGS. 4-7, the procedures for replacing the toner bottle 1 will be described. Incidentally, FIG. 4(A) shows the state of the toner bottle 1 immediately after the placement of the toner bottle on the bottle tray 50. FIG. 4(B) shows the state of toner bottle while the lever 11 is rotationally moved. FIG. 4(C) shows the state of the toner bottle after the completion of the rotational movement of the lever 11. FIGS. 5-7 are enlarged drawings of the essential portions of toner supplying apparatus and toner bottle, and correspond to FIGS. 4(A)-4(C), respectively.

First, the procedure for mounting the toner bottle 1 in the toner supplying apparatus will be described.

Referring to FIG. 4(A), first, the bottle replacement cover 15 is to be opened, and then, the toner bottle 1 is to be placed on the bottle tray 50. FIG. 5 is an enlarged drawing of the above-mentioned essential portions immediately after the placement of the toner bottle 1 on the bottle tray 50. At this point in the procedure, the toner bottle 1 is yet to be connected to the toner supplying apparatus so that the toner bottle 1 can be driven by the toner supplying apparatus.

Next, the lever 11 is to be rotated in the direction indicated by an arrow mark S in FIG. 4(B).

As the lever 11 is rotated, the bottle tray 50 advances in the direction indicated by an arrow mark a, causing the hook portion 2*a* of the coupling portion 2 to enter the central space (hollow) of the driving ring 3 and hook the driving ring 3 as shown in FIG. 6.

Next, the lever 11 is to be further rotated in the direction indicated by the arrow mark S in FIG. 4(C). As the lever 11 is rotated, the bottle tray 50 is moved backward in the direction indicated by the arrow mark b by a cam groove 11*a*. During this backward movement of the bottle tray 50, the coupling portion 2 engages the driving ring 3 by its hook portion 2*a*, and also, the driving ring 3, drive shaft 5, and driving gear 6 slide with the toner bottle 1 in the direction indicated by the arrow mark b, because the sealing portion 2*e* is in the hole (toner outlet) of the cylindrical portion 1*a*.

As the driving ring 3 slides in the direction indicated by the arrow mark b, the driving gear 6 collides with the frame 20 (FIGS. 7 and 12), being preventing, along with the coupling portion 2, from sliding further.

Thereafter, the toner bottle 1 is retracted further. At this point of the procedure, the coupling portion 2 is prevented by the driving ring 3 from sliding further in the direction parallel with the rotational axis of the toner bottle 1. Thus, as the toner bottle 1 is retracted further, only the container proper slides, while the seal portion 2*e* of the coupling portion 2 is kept stationary.

As a result, the seal portion 2*e* of the coupling portion 2 is separated from the container proper; and the toner bottle 1 becomes open at the end of the cylindrical portion 1*a* of the toner bottle 1.

During this step, the driving force transmitting member (driving gear 6) of the coupling portion 2, which has been retracted (in second position), being therefore prevented from receiving the driving force, slides into the driving position (first position), in which it is in connection with the motor gear 8. As a result, it becomes possible for the rotational driving force to be transmitted from the motor gear 8 to the driving force transmitting member (driving gear 6).

That is, as the toner bottle 1 is slid to unseal the toner bottle 1, it becomes possible for the rotational driving force to be transmitted from the motor 9 to the toner bottle 1. As a result, it becomes possible for the main assembly of the image forming apparatus 100 to be replenished with the toner from the toner bottle 1.

Lastly, the user shuts the bottle replacement cover 15 to complete the operation for mounting the toner bottle 1. Thereafter, as the motor 9 is started by a command from the control portion of the image forming apparatus 100, the toner bottle 1 is rotated, and the toner is discharged into the sub-hopper 10.

Next, the procedure for taking the toner bottle 1 out after the toner bottle 1 becomes empty (toner in toner bottle 1 is completely discharged from toner bottle 1) will be described. This procedure is the reversal of the above-described procedure for mounting the toner bottle 1.

More concretely, first, the bottle replacement cover 15 is to be opened, and the lever 11 is to be rotated in the opposite direction from the direction (direction S in FIG. 4) in which it is to be rotated to mount the toner bottle 1. As the lever 11 is rotated, the bottle tray 50 is advanced in the direction indicated by the arrow mark a by the cam groove 11*a*, causing the driving ring 3, drive shaft 5, and driving gear 6 to slide together in the direction indicated by the arrow mark a until the driving gear 6 collides with the frame 30 (FIG. 7), because the hook portions 2*a* of the coupling portion 2 are in engagement with the driving ring 3.

The colliding of the driving gear 6 with the frame 30 prevents the driving ring 3 from sliding further. As a result, the coupling portion 2, which is in engagement with the driving ring 3, also stops sliding.

Thereafter, the toner bottle 1 is advanced further. As the toner bottle 1 is advanced, the sealing portion 2*e* of the coupling portion 2 fits into the hole (toner outlet) of the cylindrical portion 1*a* (sealing portion 2*e* seals cylindrical portion 1*a*). That is, the toner outlet of the cylindrical portion 1 is resealed.

Also during this step, the driving force transmitting portion (driving gear 6) of the coupling portion 2, which has been in the position (first position) in which it remains in connection with the motor gear 8, slides into the retreat (second position 2) in which it remains disconnected from the motor gear 8, being therefore prevented from receiving the driving force. As a result, it becomes impossible for the rotational driving force from being transmitted from the motor gear 8 to the driving force transmitting portion (driving gear 6).

Further, in this embodiment, as the toner bottle 1 is slid to be resealed, the hook portions 2*a* of the coupling portion 2 engage into the holes of the driving ring 3, as will be described later.

More concretely, as the toner bottle 1 is slid to be resealed, the release projections 2*b*, with which the supporting portions 2*d* of the coupling portion 2 are provided, are pressed by the release ring 4.

That is, as the above-described lever 11 is rotated to take the toner bottle 1 out, the release ring 4 is made to slide onto the driving ring 3 by the rotation of the lever 11. As a result, inward surface of the release ring 4, in terms of the radius direction of the release ring 4, presses the release projections 2*b* of the coupling portion 2 of the toner bottle 1, inward of the coupling portion 2, in terms of the radius direction of the coupling portion 2.

As a result, the hook portions 2*b* displace inward of the coupling portion 2 in terms of the radius direction of the coupling portion 2, allowing the coupling portion 2, which is in the opening of the cylindrical portion 1*a* of the toner bottle 1, to move in the direction to be separate from the driving ring 3, along with the toner bottle 1, by the above-described rotation of the lever 11 for taking the toner bottle out of the main assembly of the image forming apparatus 100.

Thus, it is possible to properly disengage the hook portions 2*a* of the coupling portion 2 from the driving ring 3.

After the disengagement of the hook portions 2*a* from the driving ring 3, the toner bottle 1 is to be removed from the bottle tray 50 to end the operation for taking the toner bottle 1 out of the image forming apparatus 100.

Thereafter, a brand-new toner bottle 1, or a toner bottle 1 refilled with toner, is to be mounted, as necessary, into the toner supplying apparatus, following the above-described procedure for removing the toner bottle 1.

(Structural Arrangement for Freeing Driving Force Transmitting Portion During Disengagement)

In this embodiment, the apparatus main assembly is structured so that the driving gear 6 of the driving force transmitting portion of the driving mechanism 200 can be slidingly moved between the point at which the driving gear 6 engages with the motor gear 8, and the point at which the driving gear 6 disengages from the motor gear 8, as described above.

This structural arrangement makes it possible for the driving ring 3 to freely rotate, by disconnecting the toner bottle 1 from the driving motor 9 before disengaging the hook portions 2*a* of the coupling portion 2 from the driving mechanism 200.

More concretely, while the release ring 4 keeps the release projections 2*b* of the coupling portions 2*b* displaced inward of the coupling portion 2 in terms of the radius direction of the coupling portion 2, the driving ring 3 is disconnected from the motor gear 8 to make it possible for the driving ring 3 to freely rotate thereafter.

This procedure makes it easier for the supporting portions 2*d* to displace inward of the coupling portion 2 in terms of the radius direction of the coupling portion 2, when pressure is applied to the release projections 2*b* in the direction to displace them inward of the coupling portion 2 in terms of the radius direction of the coupling 2, as described in the "Prior Art" section of this document. That is, it prevents the problem that when the coupling portion 2 is disengaged by the release ring 4 from the driving ring 3, the supporting portions 2*d* remain firmly pinched between the rib portions 3*b* of the driving ring 3 and the rigid portions 2*f* of the coupling portion, one for one, and therefore, it is difficult for the supporting portions 2*d* to displace inward of the coupling portion 2 in terms of the radius direction of the coupling portion 2.

Next, referring to FIGS. 12-14, this disengagement of the coupling portion 2 from the driving ring 3 will be described in detail.

Figure 12:
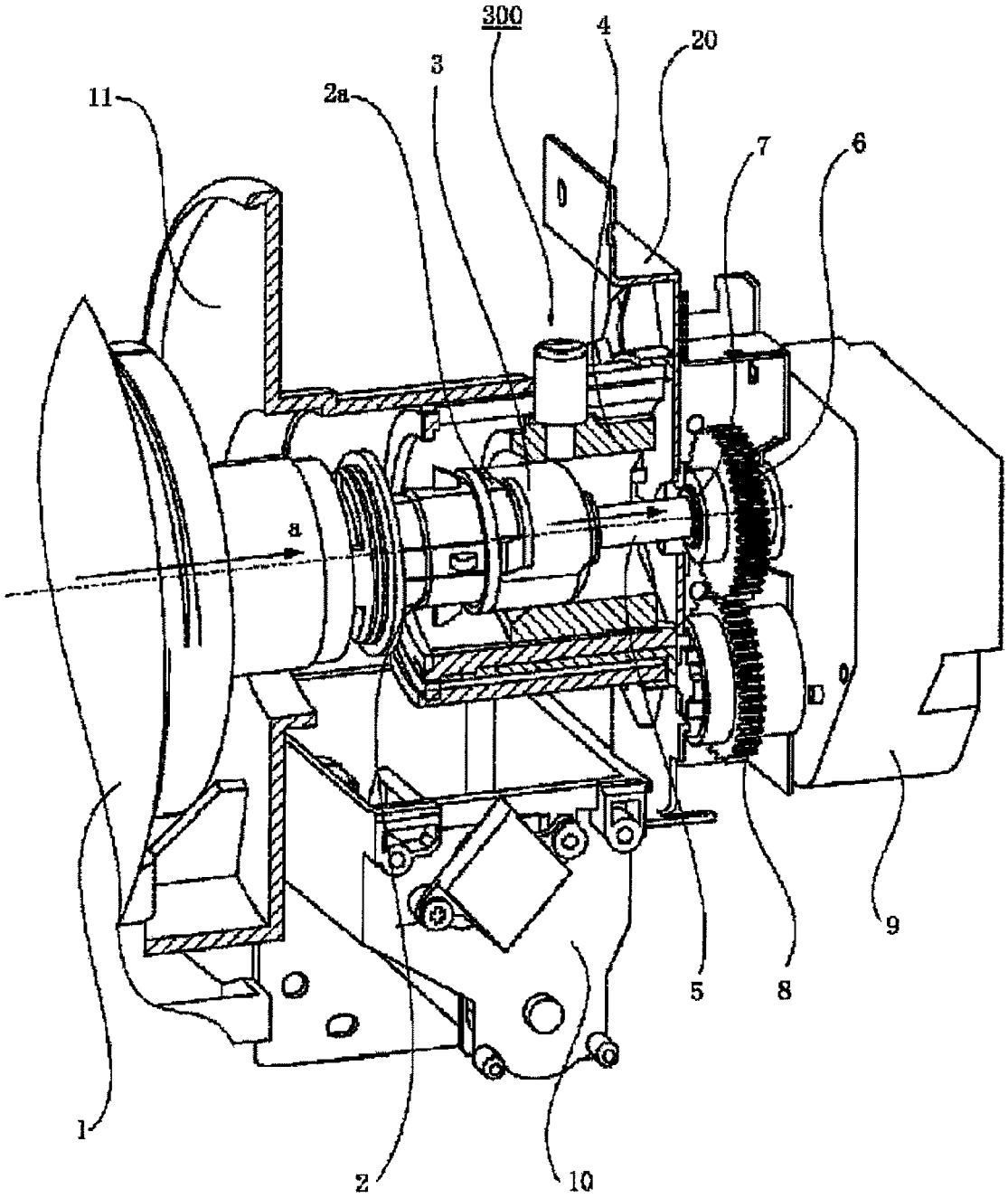
FIG. 12 is a partially broken perspective view of the combination of the toner releasing portion of the toner bottle and the toner bottle driving portion of the toner supplying apparatus, showing the operation for taking the toner bottle out of the toner supplying apparatus.

FIG. 12 shows the joint between the toner bottle 1 and the toner receiving portion of the main assembly of the image forming apparatus, which is in the condition in which the toner bottle 1 is in engagement with the driving ring 3, and therefore, the main assembly can be replenished with the toner from the toner bottle 1. When the joint is in this condition, not only is the coupling portion 2 in engagement with the driving ring 3, but also, the driving gear 6 is in mesh with the motor gear 8. In other words, when the joint is in this condition, the rotational driving force can be transmitted from the motor 9 to the toner bottle 1.

The drive shaft 5 is integral with the driving ring 3. One end of the drive shaft 5 is provided with a spring 7, which is sandwiched between the frame 20 and driving gear 6. While the toner bottle 1 is open, the spring 7 remains compressed.

As the lever 11 is rotated by a user in the opposite direction from the direction indicated by the reference character S in FIG. 4, the bottle tray 50 and toner bottle 1 are slid together in the direction indicated by an arrow mark a by the rotational movement of the lever 11.

Then, at virtually the same time as the sealing portion 2*e* of the coupling portion 2 fitting into the hole (toner outlet) of the cylindrical portion 1*a*, the driving ring 3 and driving gear 6 also are slid by the resiliency of the spring 7 in the direction indicated by the arrow mark a. Incidentally, it does not matter which is earlier, the timing with which the cylindrical portion 1*a* of the toner bottle 1 is resealed, or the timing with which the driving ring 3 is slid.

Because the driving ring 3 remains pressured in the direction indicated by the arrow mark a by the spring 7, the driving ring 3 automatically slides in the direction indicated by the arrow mark a, as the toner bottle slides in the direction indicated by the arrow mark a.

Figure 13:
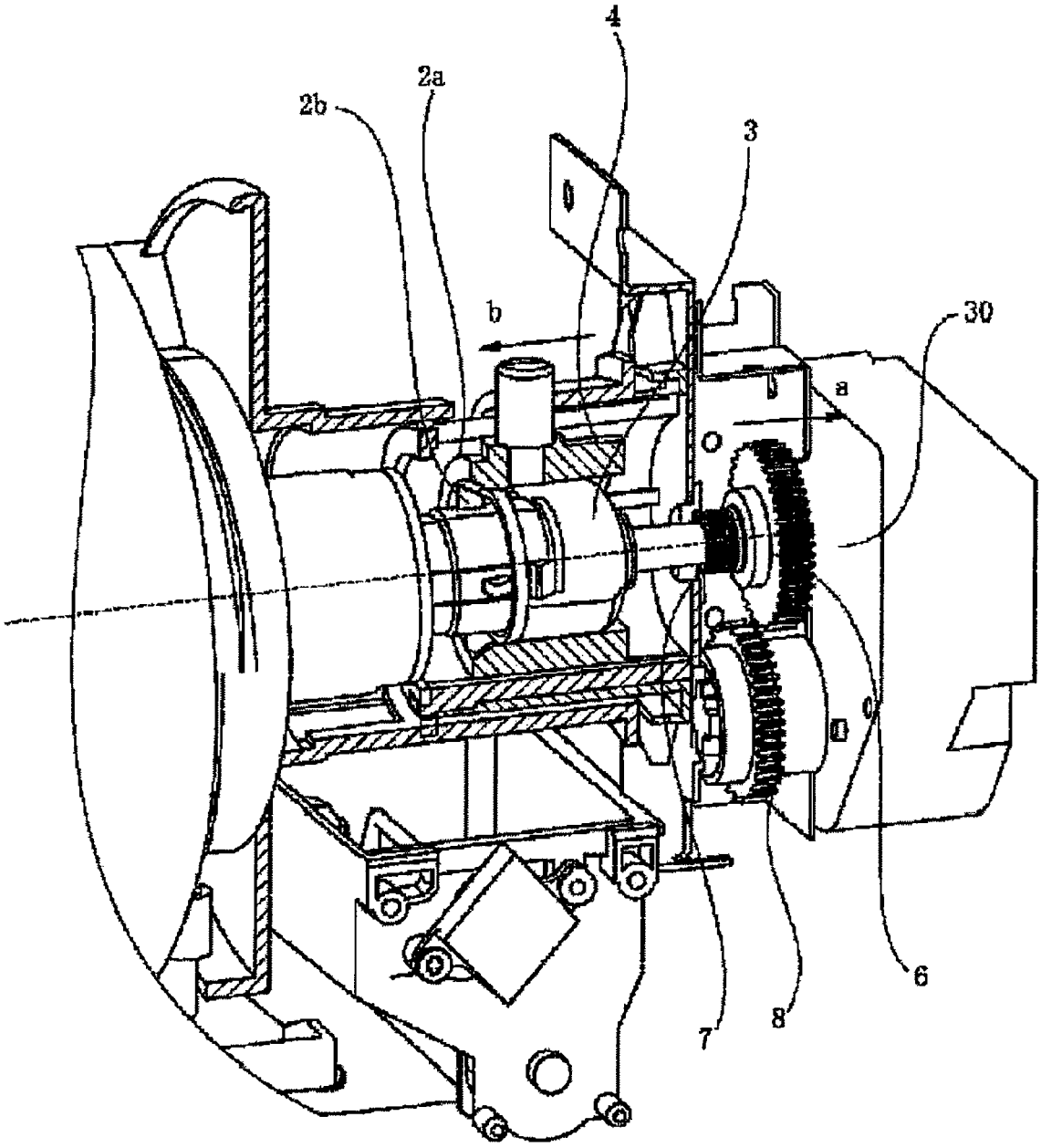
FIG. 13 is a partially broken perspective view of the combination of the toner releasing portion of the toner bottle and the toner bottle driving portion of the toner supplying apparatus, showing the operation for taking the toner bottle out of the toner supplying apparatus.

FIG. 13 shows the joint between the toner bottle 1 and toner supplying apparatus, in which the lever 11 has been further rotated from the position shown in FIG. 12.

As the toner bottle 1 is slidingly moved in the direction indicated by the arrow mark a by the rotational movement of the lever 11, the driving ring 3 and driving gear 6 are made to retreat in the direction indicated by the arrow mark a by the resiliency of the spring 7.

As a result, the driving gear 6, which was in mesh with the motor gear 8, becomes disengaged from the motor gear 8. As soon as the driving gear 6 becomes disengaged from the motor gear 8, it becomes possible for the driving ring 3, drive shaft 5, and driving gear 6 to easily rotate.

After the above-described removal of the load from the driving ring 3, there is no tension between the coupling portion 2 and driving ring 3, and therefore, there is virtually no rotational resistance between the two.

Figure 11:
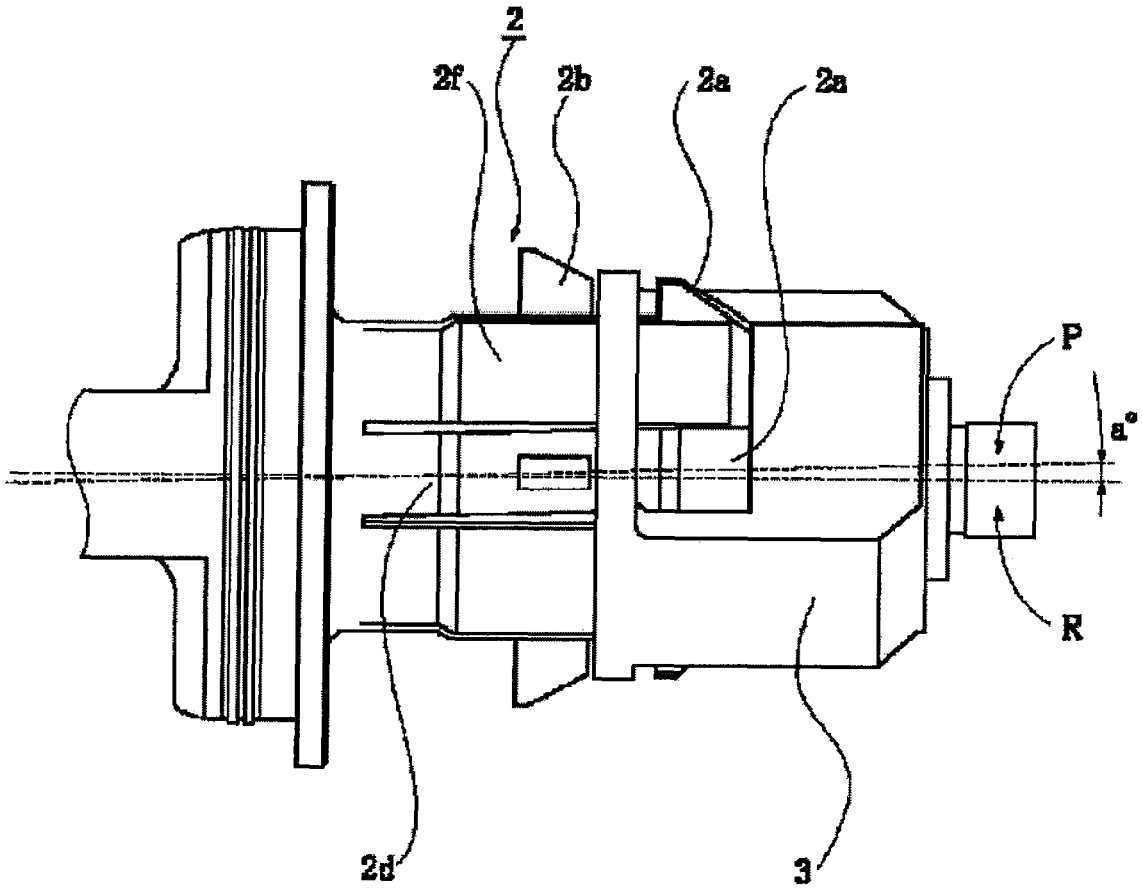
FIG. 11 is a side view of the engaged combination of the coupling portion of the toner bottle and the driving ring of the toner supplying apparatus, when the coupling portion is under the load after the rotation of the toner bottle is stopped.

Thus, there is no deformation of the supporting portion 2*d*, such as the one described with reference to FIG. 11, in terms of the circumferential direction of the supporting portion 2*d*. Therefore, as the release ring 4 presses the release projections 2*b* of the coupling portion 2 by sliding in the direction indicated by the arrow mark b, the supporting portion 2*d* smoothly flex.

Figure 14:
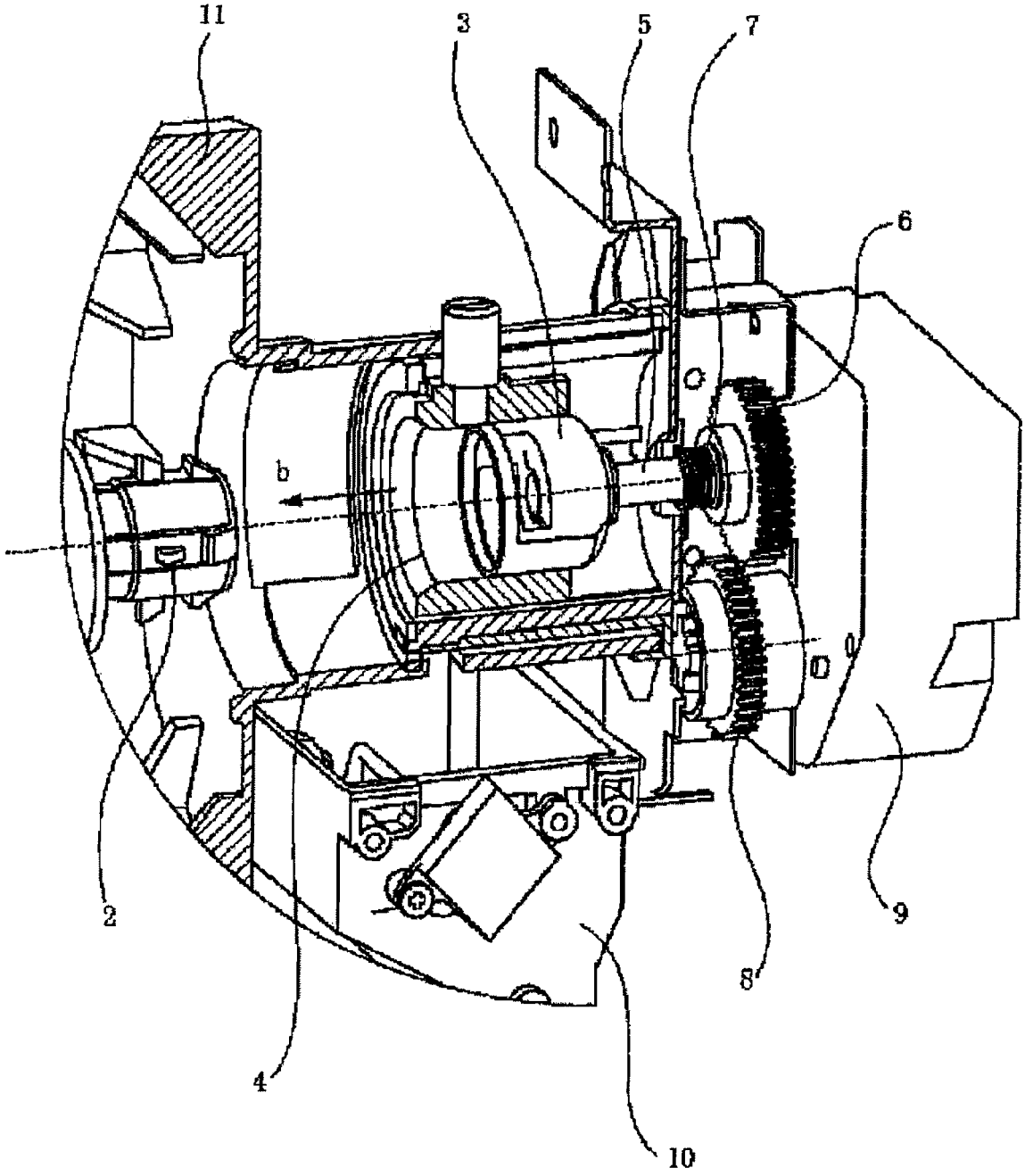
FIG. 14 is a partially broken perspective view of the combination of the toner releasing portion of the toner bottle and the toner bottle driving portion of the toner supplying apparatus, showing the operation for taking the toner bottle out of the toner supplying apparatus.

FIG. 14 shows the joint between the toner bottle 1 and the toner supplying apparatus after the lever 11 was rotated further from the position shown in FIG. 13.

After the disengagement of the hook portions 2*a* of the coupling portion 2 from the holes 3*a* of the driving ring 3, the toner bottle is carried by the bottle tray 50 in the direction indicated by the arrow mark b, as the bottle tray 50 is slid by a preset distance to the bottle removal position, so that the user can remove the toner bottle 1.

As described above, the toner supplying apparatus is structured so that the driving force transmitting member (driving gear 6) is allowed to freely rotate. Thus, it is possible to properly flex the supporting portions 2*d* inward of the coupling portion 2 in terms of the radius direction of the coupling portion 2 through the process of applying force to the release projections 2 by the release ring 4.

That is, it is possible to properly disengage the hook portions 2*a* from the driving ring 3 by disengaging the driving gear 6 from the motor gear 8 by utilizing the procedure for moving (sliding) the toner bottle 1 for removal. Therefore, the amount of force necessary to rotate the lever 11 for the removal of the toner bottle 1 is smaller. That is, this embodiment can substantially reduce the amount of force necessary to rotate the lever 11 to remove the toner bottle 1.

Incidentally, in the case of the above-described embodiment, the sealing portion 2*e* is an integral part of the coupling portion 2. However, the coupling portion 2 and sealing portion 2*e* may be structured as shown in FIG. 16.

Figure 16:
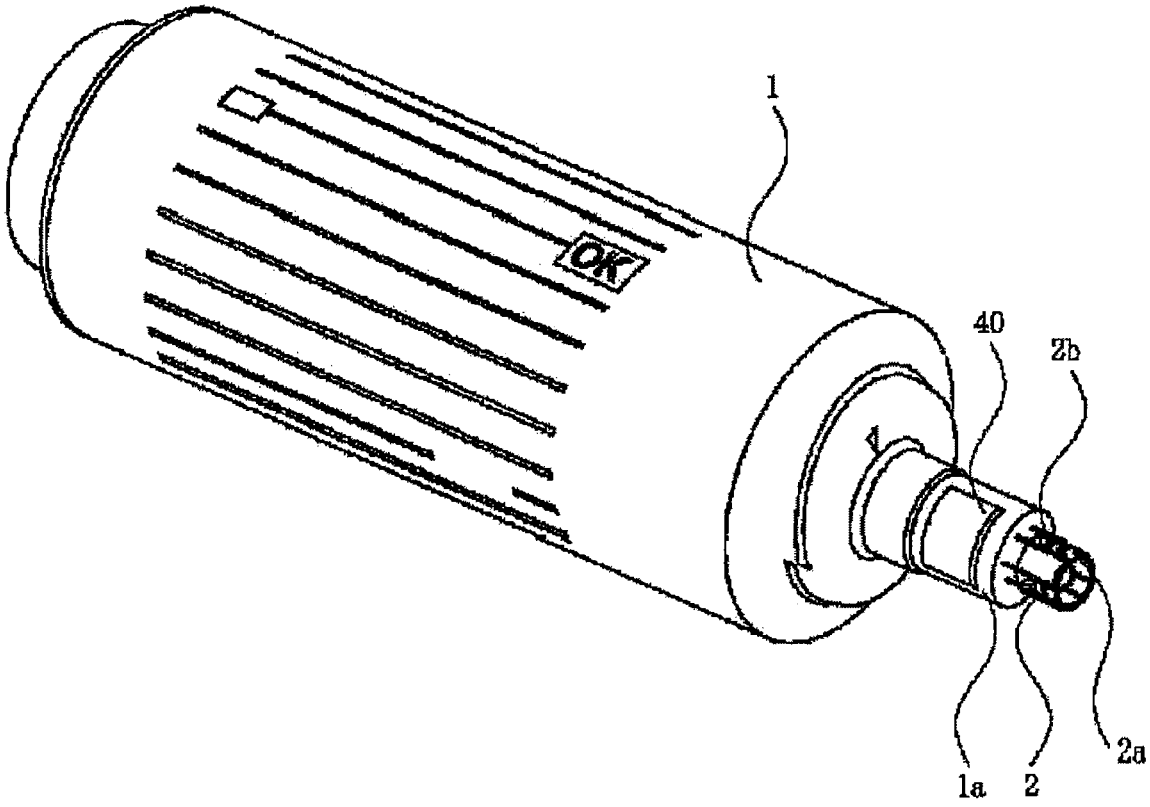
FIG. 16 is a perspective view of yet another example the toner bottle in accordance with the present invention.

More concretely, referring to FIG. 16, the cylindrical wall of the cylindrical portion 1*a* is provided with a hole which serves as the toner outlet, and this hole is exposed or shut by a shutter 40, which is independent from the coupling portion 2. Further, the toner bottle 1 is structured so that the shutter 40 can be slidingly moved along the peripheral surface of the cylindrical portion 1*a*. The structure of the coupling portion 2 of this modified version of the toner bottle 1 is the same as that of the coupling portion 2 in this embodiment.

Embodiment 2

Next, referring to FIG. 15, the structure of the toner bottle and toner supplying apparatus in the second embodiment of the present invention will be described. The components, parts thereof, etc., of the toner bottle and toner supplying apparatus in this embodiment, which are the same in structure as the counterparts in the first embodiment, will be given the same referential codes as those given to the counterparts in the first embodiment, and will not be described in detail. That is, the components, parts thereof, etc., in this embodiment, which have the same referential codes as those given to their counterparts in the first embodiment, are the same in structure as their counterparts in the first embodiment, unless specifically noted.

This embodiment is different from the first embodiment in that the toner bottle 1 and toner supplying apparatus in this embodiment are structured so that the toner bottle 1 is inserted into, or removed from, the toner supplying apparatus in the direction (indicated by arrow mark a) parallel with the lengthwise direction of the toner bottle 1.

The procedure for mounting or removing the toner bottle 1 in this embodiment is as will be described next.

First, a user is to open the bottle replacement cover, and then, insert the toner bottle 1 into the bottle insertion opening, in the direction indicated by an arrow mark a.

Then, the user is to rotate the lever 11 in the direction indicated by an arrow mark S to set the toner bottle 1 in the toner supplying apparatus.

Figure 15:
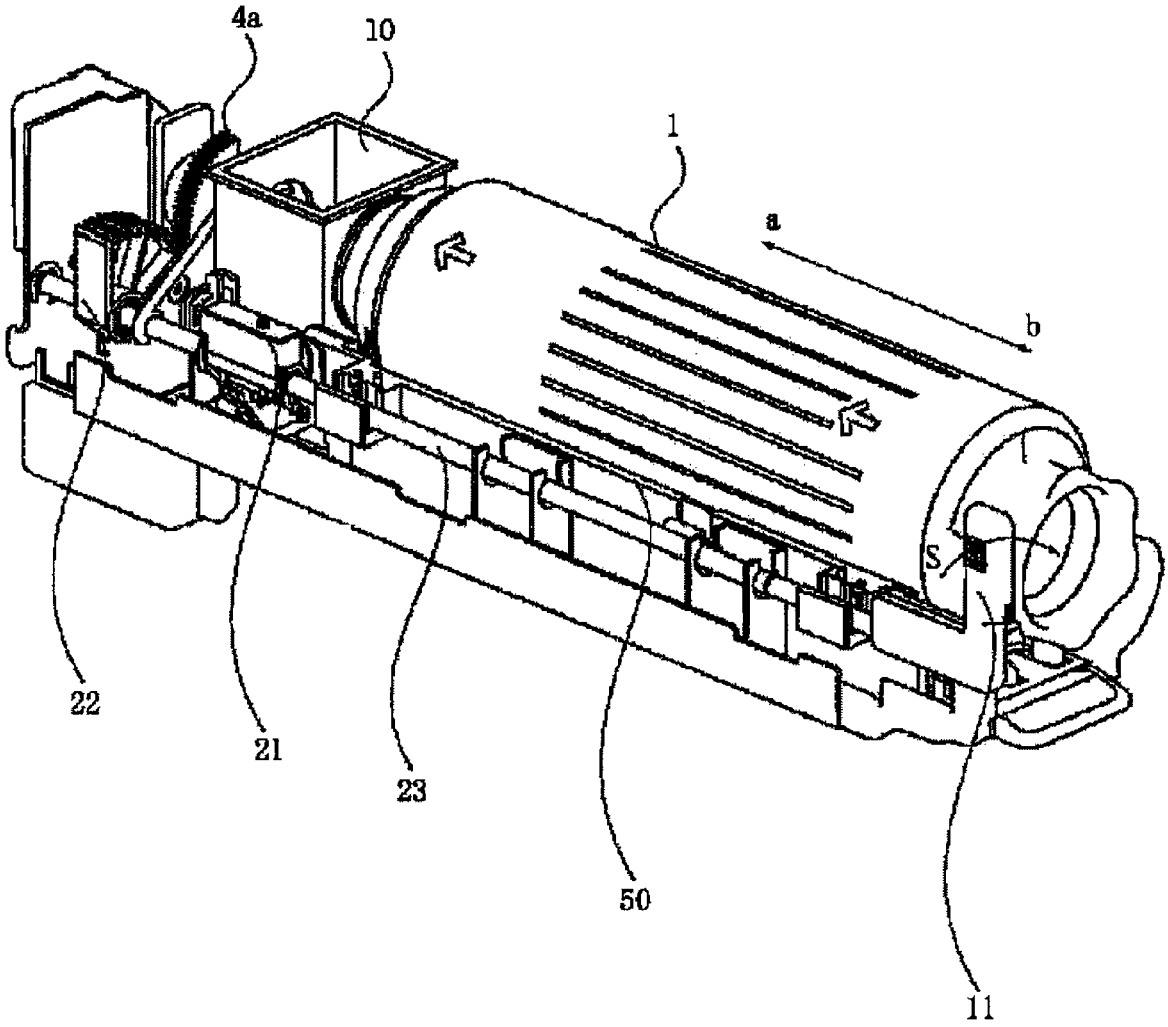
FIG. 15 is a perspective view of another example of the toner bottle in accordance with the present invention.

The shaft 23 in FIG. 15 is in connection to the lever 11, a cam slider 21, and a lever gear 22. Thus, as the lever 11 is rotated, the cam slider 21 rotates, causing the bottle tray 50 to slide (advance) in the direction indicated by the arrow mark a.

This advancement of the bottle tray 50 causes the hook portions 2*a* of coupling portion 2 to engage with the driving ring 3. Then, the user is to further rotate the lever 11 after the engagement of the coupling portion 2 and driving ring 3. The further rotation of the lever 11 causes the cam slider 21 to slide the bottle tray 50 in the direction (backward) indicated by an arrow mark b. As a result, the sealing portion 2*e* of the coupling portion 2 separates from the toner bottle 1. That is, the toner bottle 1 is unsealed, making it possible for the image forming apparatus to be supplied with the toner from the toner bottle 1.

All that is necessary to remove the toner bottle 1 is to rotate the lever 11 in the opposite direction from the direction in which the lever 11 is rotated to mount the toner bottle 1.

Also in this embodiment, the load, to which the driving ring 3 would have been subjected when the hook portions 2*a* of the coupling portion 2 are disengaged from the driving ring 3, is removed by the rotation of the lever 11 in the opposite direction, and therefore, it becomes possible for the driving ring 3 to freely rotate, which in turn makes it possible for the supporting portions 2*d* of the coupling 2 to easily flex inward of the coupling 2 in terms of the radius direction of the coupling 2, preventing thereby the problem that the toner bottle 1 fails to properly disengage from the toner supplying apparatus.

As the above-described procedure is carried out, it becomes possible for the user to take the bottle out of the toner supplying apparatus (image forming apparatus).

That is, even if the direction in which the toner bottle 1 is mounted is different from the direction in which the toner bottle 1 is mounted in the first embodiment, the present invention is applicable as described above.

Embodiment 3

Next, the third preferred embodiment will be described. This embodiment is different from the first and second embodiment described above, in the driving mechanism 200 and release mechanism 300. That is, in terms of the other structural features, this embodiment is the same as the first and second embodiments. Further, in terms of the direction in which the toner bottle 1 is mounted into, or taken out of, the toner supplying apparatus, this embodiment is the same as the second embodiment. Further, in terms of the toner bottle structure, this embodiment is the same as the first and second embodiments.

In the first and second embodiments, the image forming apparatus is structured so that when the toner bottle 1 is set or released, it is slidingly moved. It is in terms of this movement of the toner bottle 1 that this embodiment is different from the first and second embodiments. That is, in this embodiment, the image forming apparatus is structured so that when the toner bottle 1 is set or released, it is not moved, and instead, the driving mechanism 200 and releasing mechanism 300 are made to advance/retreat.

Figure 25:
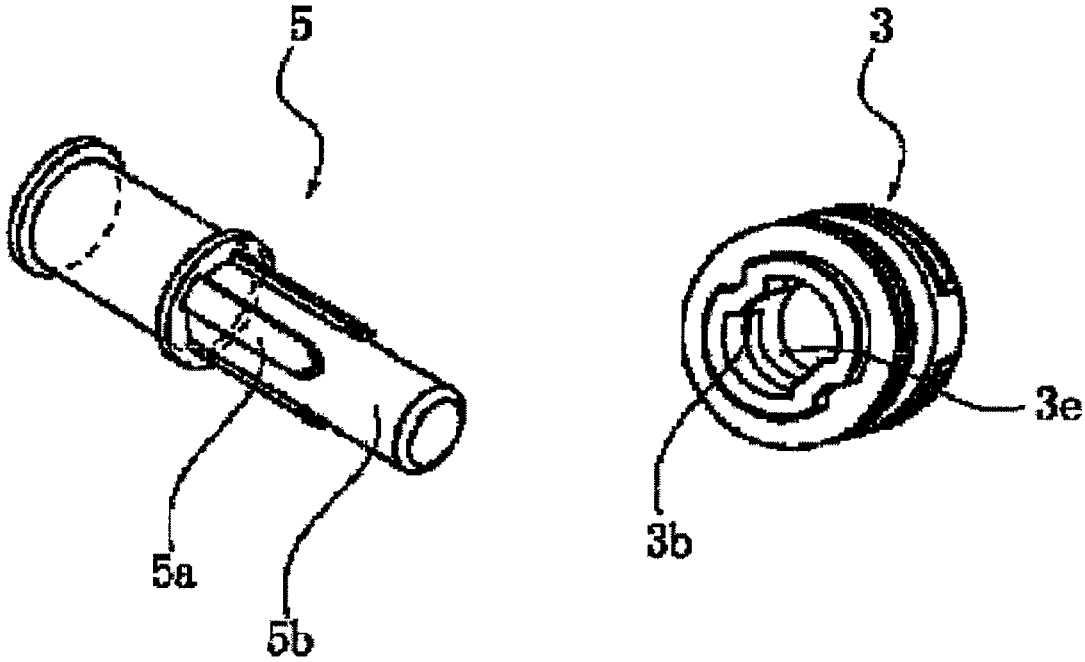
FIG. 25 is a perspective view of the driving mechanism.

The driving mechanism 200 in this embodiment is structured as shown in FIG. 25.

That is, the wall of the central hollow of the driving ring 3 is provided with a groove 3*b*, which engages with the projections 5*a* of the drive shaft 5. Further, the driving ring 3 is provided with a hole 3*e*, in which the driving ring engaging portion 5*b* of the drive shaft 5 fits. In other words, the toner supplying apparatus in this embodiment is structured so that the rotational driving force is transmitted to the driving ring 3 by the driving ring engaging portion 5*b* of the drive shaft 5. Further, the drive shaft 5 and driving ring 3 are structured so that the driving ring 3 is allowed to slide on the driving shaft 5 in the direction parallel with the rotational axis of the drive shaft 5 (directions indicated by arrow marks a and b in FIGS. 20 and 21, respectively).

Next, the differences (modifications) of this embodiment from the first and second embodiments will be concretely described along with the operation for setting the toner bottle 1 and the operation for releasing the toner bottle 1.

(Operation for Setting Toner Bottle)

Figure 24:
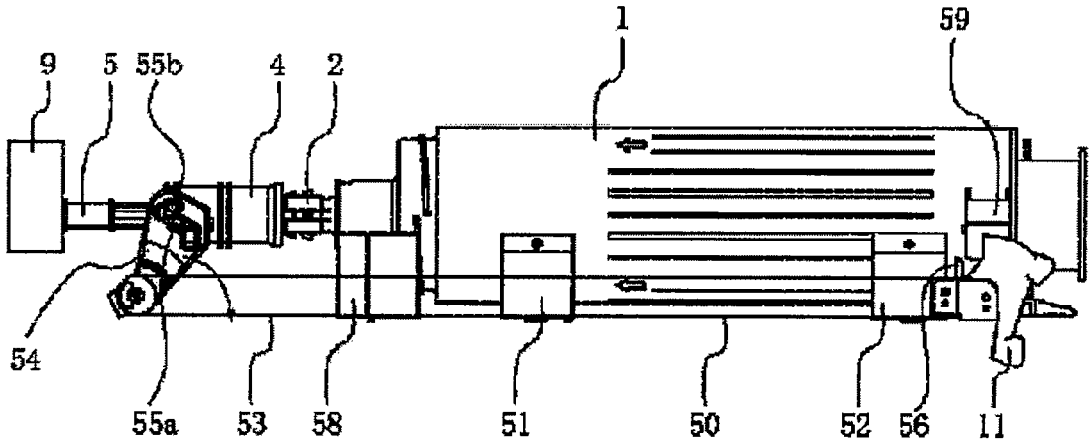
FIG. 24 is also a combination of the drawings of the toner releasing end portion of the toner bottle 1, and the toner receiving portion of the image forming apparatus (toner supplying apparatus), showing the operation for taking the toner bottle out.

FIG. 24 shows the toner bottle 1, which has just been mounted on the bottle tray 50 by being inserted into the toner supplying apparatus through the opening exposed by the opening of the bottle replacement cover.

Figure 18:
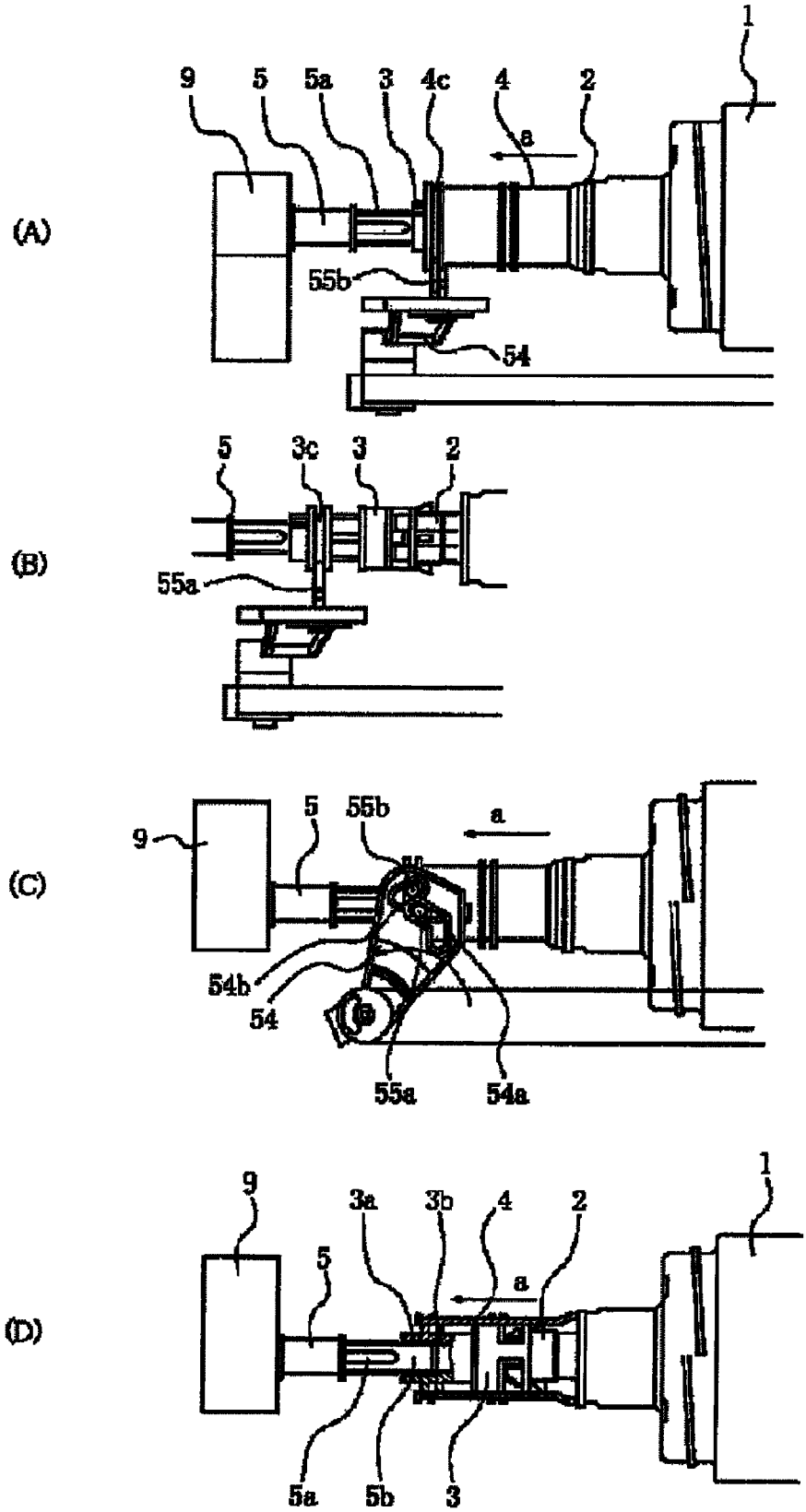
FIG. 18 is a combination of the drawings of the toner releasing end portion of the toner bottle 1, and the toner receiving portion of the image forming apparatus (toner supplying apparatus), when the toner bottle and toner receiving portion are in the condition shown in FIG. 17(A).
Figure 19:
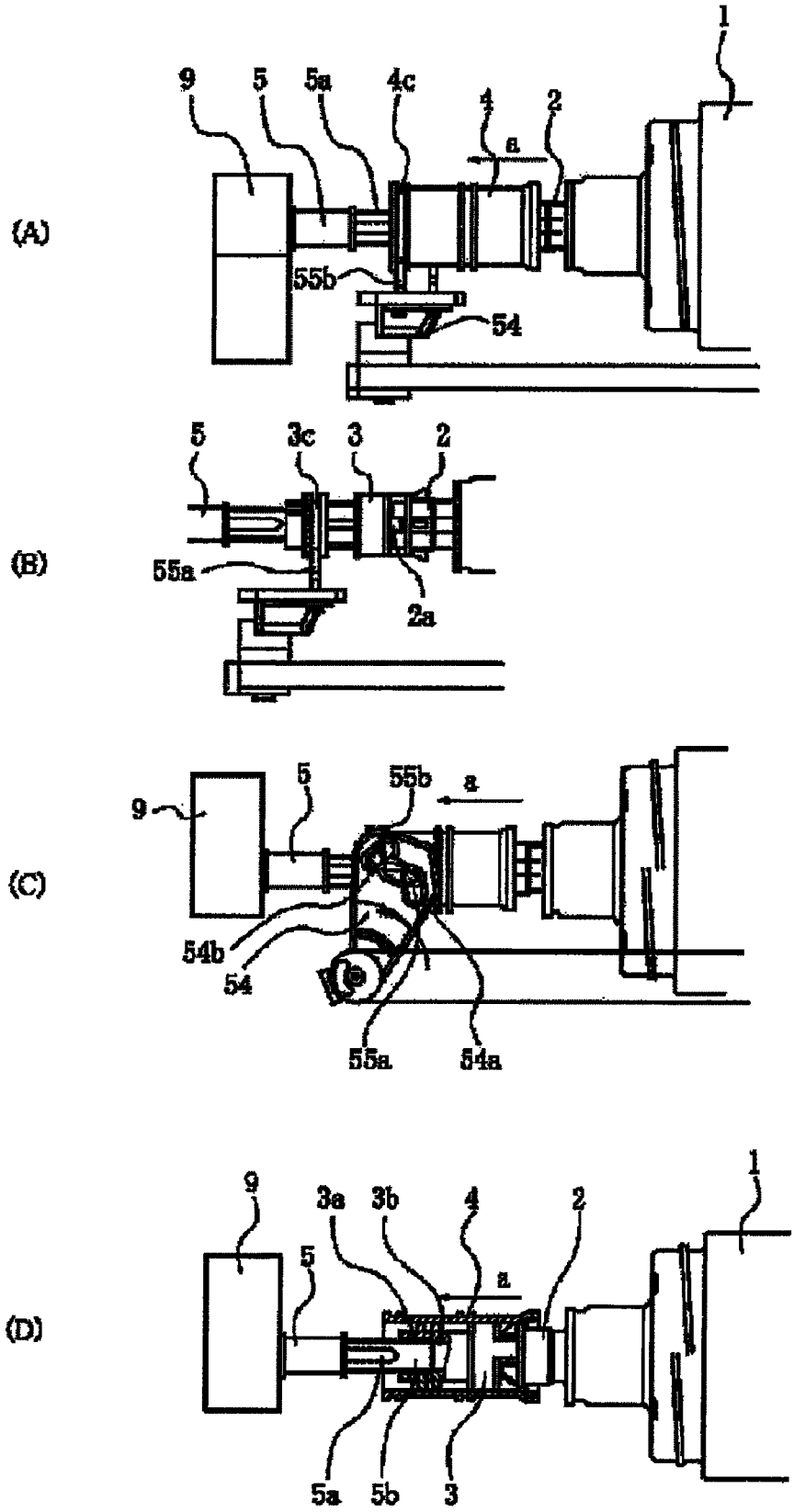
FIG. 19 is a combination of the drawings of the toner releasing end portion of the toner bottle 1, and the toner receiving portion of the image forming apparatus (toner supplying apparatus), when the toner bottle and toner receiving portion are in the condition shown in FIG. 17(B).
Figure 20:
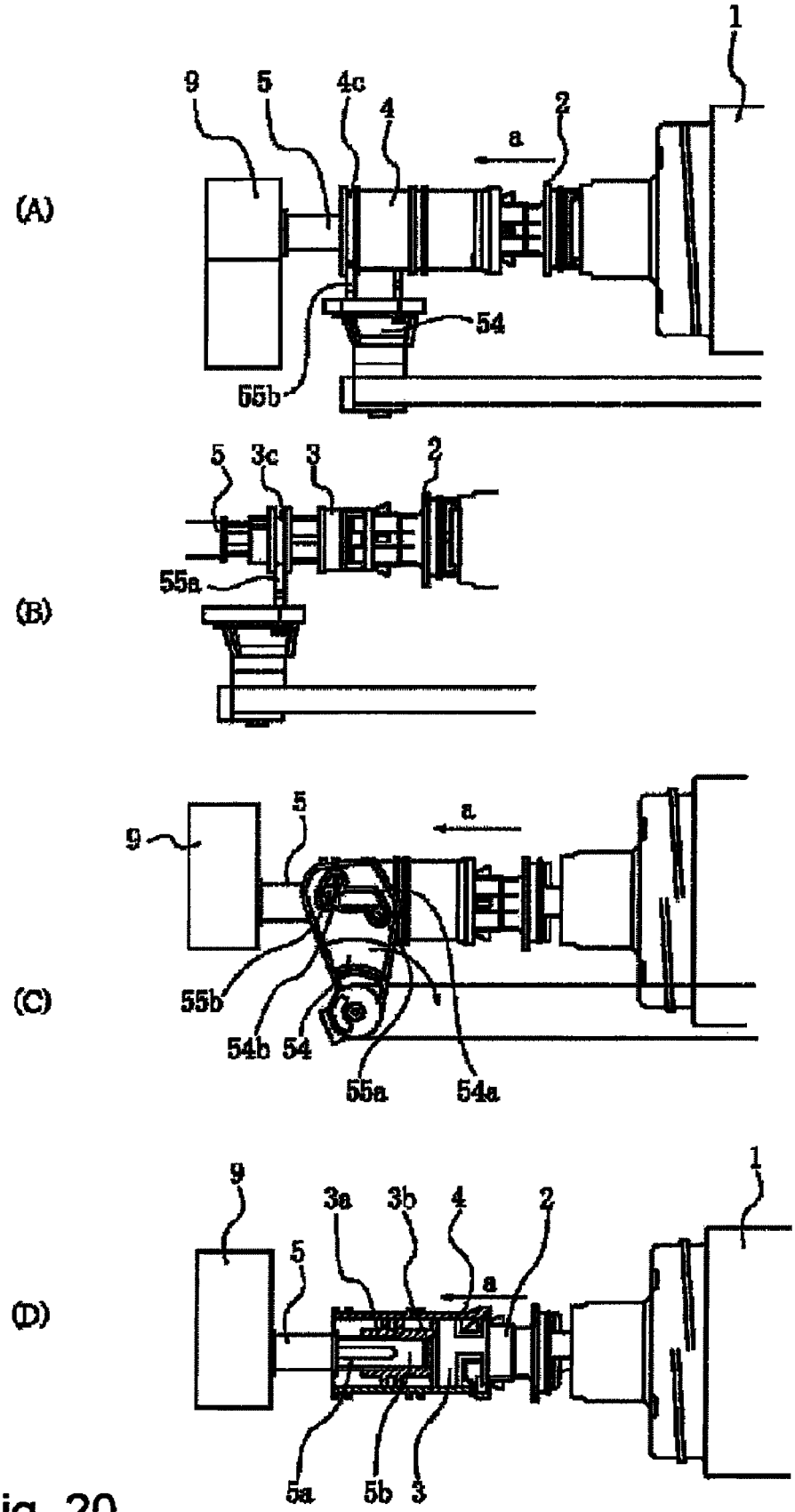
FIG. 20 is a combination of the drawings of the toner releasing end portion of the toner bottle 1, and the toner receiving portion of the image forming apparatus (toner supplying apparatus), when the toner bottle and toner receiving portion are in the condition shown in FIG. 17(C).

FIGS. 17(A)-17(C) show the states of the toner bottle 1, which occur in sequence as the lever 11 is rotated while the toner bottle 1 and the toner supplying apparatus are in the state shown in FIG. 24. FIGS. 18, 19, and 20 correspond to FIGS. 17(A)-17(C), respectively. Further, FIGS. 18(A), 19(A), and 20(A) are top plan views, and FIGS. 18(B), 19(B), and 20(B) are enlarged views, of the joint between the coupling portions and the toner supplying apparatus, shown in FIGS. 18(A), 19(A), and 20(A), respectively. Further, FIGS. 18(C), 19(C), and 20(C) are side views of the joint between the coupling portion 2 and the toner supplying apparatus, and FIGS. 18(D), 19(D), and 20(D) are enlarged views of the joint between the coupling portion and toner supplying apparatus, shown in FIGS. 18(C), 19(C), and 20(C), respectively.

Referring to FIG. 24, the toner bottle 1 is to be placed in the toner supplying apparatus in such a manner that it rests on both the front and rear bottle holders 52 and 51, which are solidly attached to the bottle tray 50. Then, the toner bottle 1 is to be pushed in the direction indicated by arrow marks until it comes into contact with a stopper 58.

As a result, the toner bottle 1 is placed in the predetermined position in the toner supplying apparatus (in the state shown in FIG. 17(A)).

Referring to FIG. 17(A), the front bottle holder 52 attached to the front side of the bottle tray 50 is provided with a lever 11 which is rotatable.

The toner supplying apparatus is structured so that as this lever 11 is rotated, a lever 54 is rotated by a belt 53 which connects the lever 1 to the lever 54.

The lever 54 is provided with cam grooves 55*a* and 55*b* (FIG. 18), in which the pins 55*a* and 55*b* for moving the driving ring 3 and releasing ring 4 forward or backward are fitted. The tip of the pin 55*a*, and the tip of the pin 55*b*, are engaged in the grooves 3*c* and 4*c* of the driving ring 3 and release ring 4, respectively. That is, the toner supplying apparatus is structured so that as the lever 11 is rotated, the driving ring 3 and release ring 4 slidingly move in the direction indicated by an arrow mark a or b relative to the cam grooves 54*a* and 54*b*, respectively.

Further, the toner supplying apparatus is structured so that as the lever 11 is rotated, a stopper lever 59 (FIG. 17) is rotated by the rotational movement of the lever 11, preventing thereby the toner bottle 1 from retreating from the above-mentioned preset position.

Then, as the lever 1 is further rotated in the direction indicated by an arrow mark S until the lever 11 reaches the position shown in FIG. 17(B), the lever 54 rotates to the position shown in FIG. 17(B).

Thus, as the lever 11 is rotated, the pin 55*b* is moved by cam groove 54*b* of the lever 54, in the direction indicated by an arrow mark a, causing the release ring 4 to retreat in the direction indicated by an arrow mark a. Then, the hook portions 2*a* of the coupling portion 2 engage with the driving ring 3, as shown in FIG. 19. The reason why the driving ring 3 remains stationary is that the cam groove 54*a* is shaped so that while the lever 54 rotates to the position shown in FIG. 17(B), the lever 54 does not move the pin 55*a*. In this stage of the rotation of the lever 11, the stopper lever 59 also is moved by the movement of the lever 11, and therefore, the toner bottle 1 is sandwiched by the stopper 58 and stopper lever 59, being thereby prevented from moving frontward or rearward.

Then, as the lever 11 is rotated further to the position in which it comes into contact with the lever stopper 56, the lever 54 is rotated by the rotation of the lever 11 as shown in FIG. 17(C). Thus, the pins 54*a* and 54*b* are moved by the cam grooves 55*a* and 55*b*, causing the driving ring 3 to retreat with the release ring 4 in the direction indicated by the arrow mark a. During this stage of the rotation of the lever 11, the driving ring 3 and coupling portion 2 remain engaged with each other, and therefore, the coupling portion 2 and driving ring 3 slide together in the direction indicated by the arrow mark a, causing the toner bottle 1 to be unsealed. Regarding the power source for the toner supplying apparatus, the drive shaft 5 of the motor 9 is provided with projections 5*a*. Thus, as the driving ring 3 is slid in the direction indicated by the arrow mark a, the projections 5*a* fit into the grooves 3*b* of the driving ring 3, making it possible for the rotational driving force from the motor 9 to be transmitted to the driving ring 3, that is, making it possible to supply the image forming apparatus with the toner from the toner bottle 1. Thereafter, the user is to close the bottle replacement cover 15 to end the toner bottle replacement operation.

(Operation for Disengaging Toner Bottle to Remove Toner Bottle)

Next, referring to FIGS. 21-23, the steps for taking the toner bottle 1 out of the toner supplying apparatus after the toner bottle set in the toner supplying apparatus is depleted of the toner therein will be described. FIGS. 21(A), 22(A), and 23(A) are top plan views, and FIGS. 21(B), 22(B), and 23(B) are enlarged views of the joint between the coupling portion and the toner supplying apparatus, shown in FIGS. 21(A), 22(A), and 23(A), respectively. Further, FIGS. 21(C), 22(C), and 23(C) are side views of the joint between the coupling portion and toner supplying apparatus, and FIGS. 21(D), 22(D), and 23(D) are enlarged views of the joint between the coupling portion and toner supplying apparatus, shown in FIGS. 21(C), 22(C), and 23(C), respectively.

Figure 21:
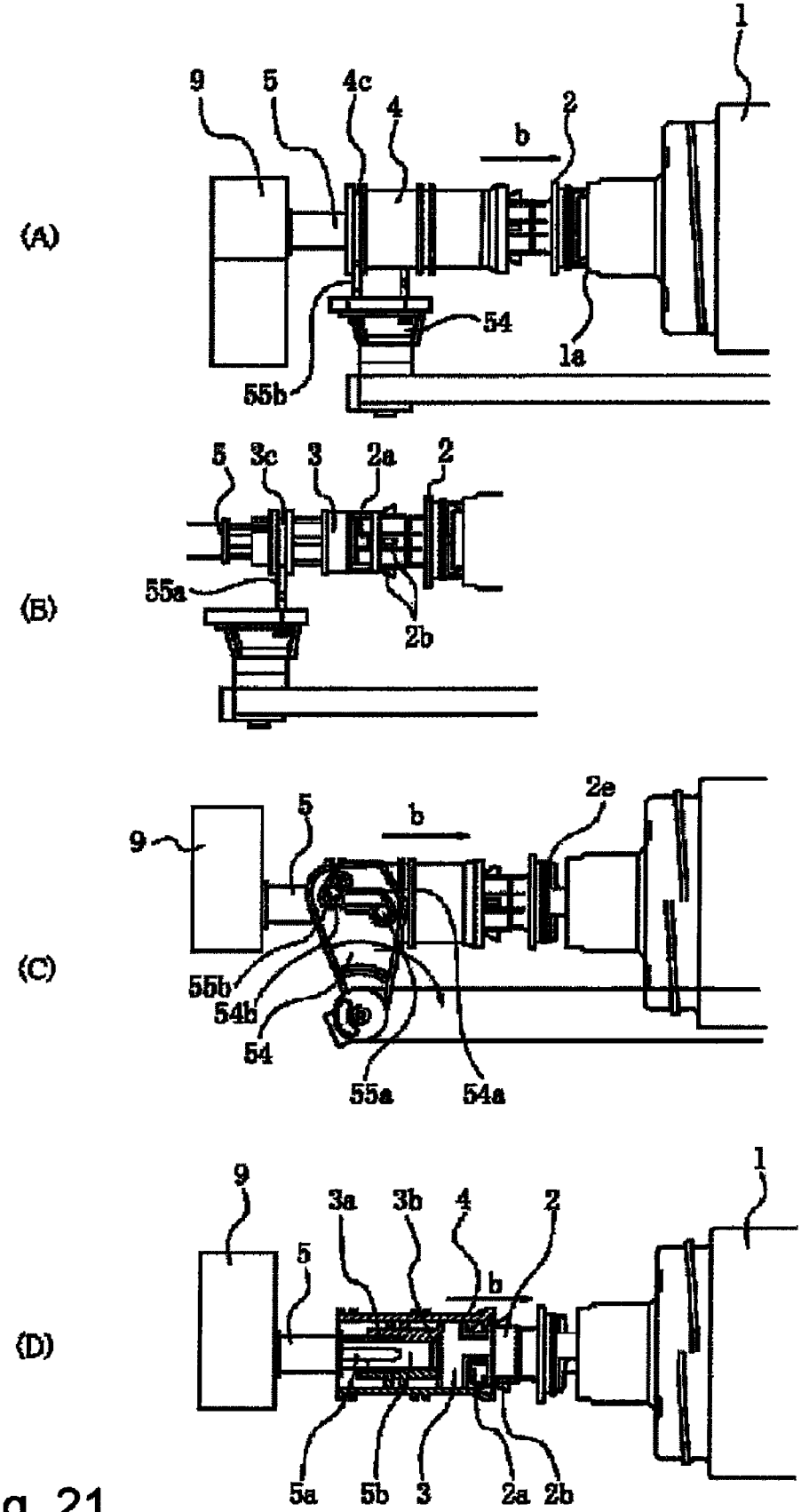
FIG. 21 is a combination of the drawings of the toner releasing end portion of the toner bottle 1, and the toner receiving portion of the image forming apparatus (toner supplying apparatus), showing the operation for taking the toner bottle out.

FIG. 21 is a rough drawing of the joint between the toner bottle 1 and the corresponding portion of the toner supplying apparatus, which is ready to supply the image forming apparatus with the toner from the toner bottle 1. When the joint is in the state shown in FIG. 21, the coupling portion 2 and driving ring 3 are in engagement with each other, and the toner outlet of the cylindrical portion 1*a* of the toner bottle 1 is open.

Figure 17:
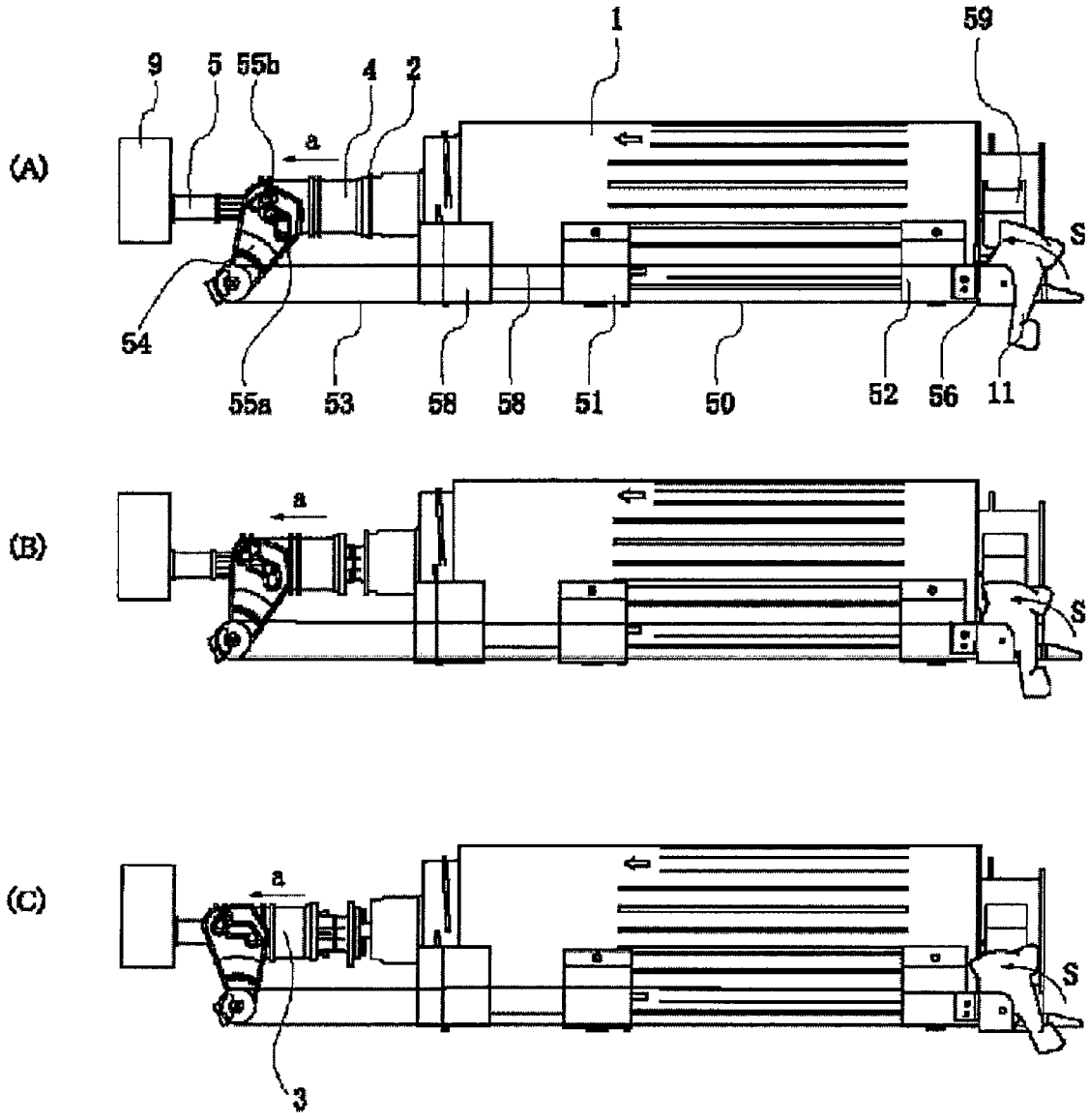
FIG. 17 is a drawing for describing the operation for setting the toner bottle in the toner supplying apparatus.

If a user wants to take the toner bottle 1 out of the toner supplying apparatus, the user rotates the lever 11 in the opposite direction from the direction indicated by the arrow mark S in FIG. 17. As the lever 11 is rotated, the driving ring 3 and release ring 4 slide in the direction indicated by the arrow mark b, and the sealing portion 2*e* of the coupling portion 2 fits into the toner outlet of the cylindrical portion 1*a*; the outlet is resealed.

Figure 22:
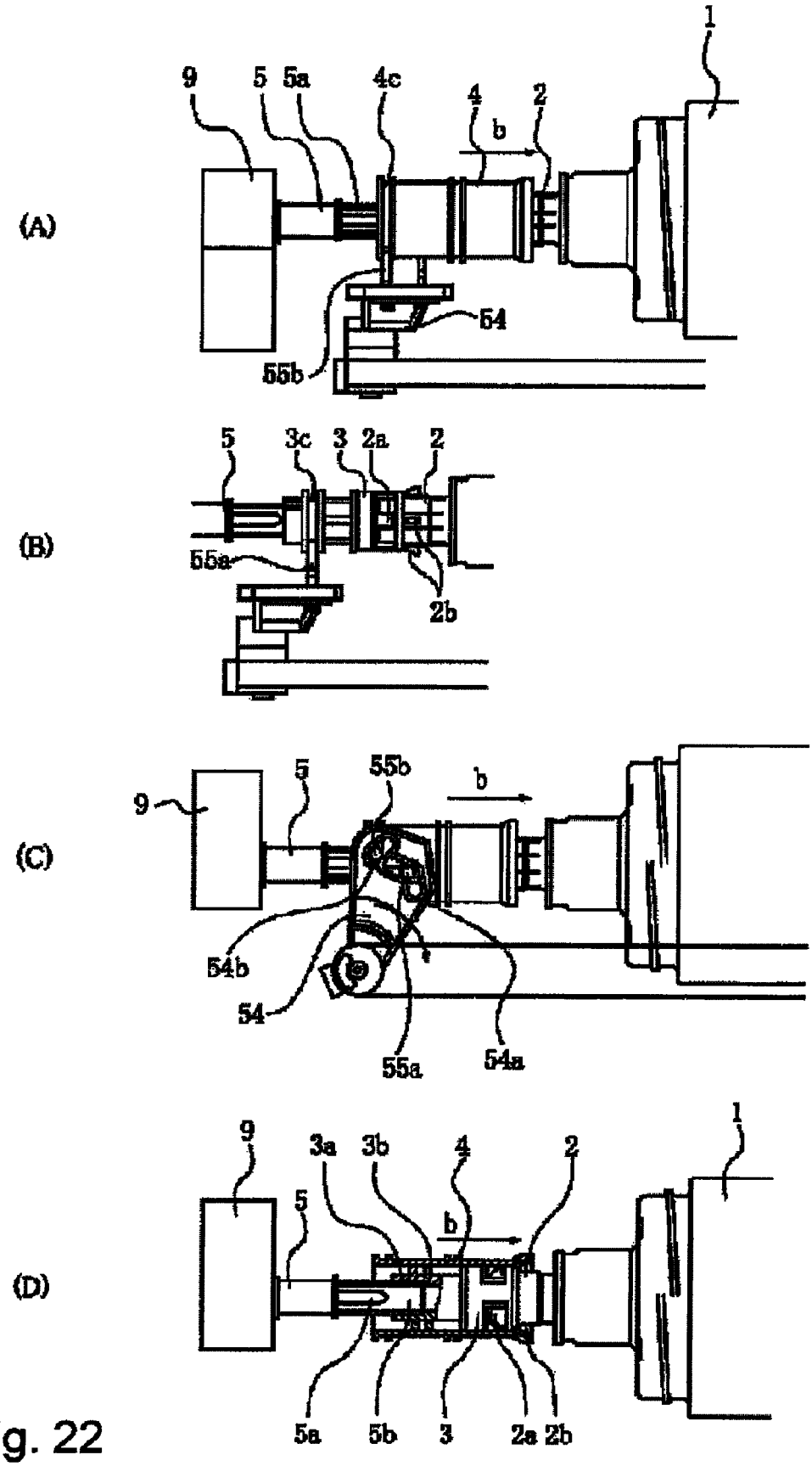
FIG. 22 is a combination of the drawings of the toner releasing end portion of the toner bottle 1, and the toner receiving portion of the image forming apparatus (toner supplying apparatus), showing the operation for taking the toner bottle out.

Next, the lever 11, which is in the position shown in FIG. 21, is to be further rotated as shown in FIG. 22. As the lever 11 is rotated, the driving ring 3 is made to slide in the direction indicated by the arrow mark b by the rotation of the lever 11. As a result, the driving ring 3 becomes disconnected from the drive shaft 5, making it impossible for the driving force from the motor 9 to be transmitted to the driving ring 3.

At the instance when the driving ring 3 becomes disengaged from the drive shaft 5, the driving ring 3 is freed from the load applied to the driving ring 3 by the motor 9 through the drive shaft 5 (it is allowed to freely rotate). Thereafter, therefore, no rotational friction attributable to the motor 9 is present between the coupling portion 2 and driving ring 3.

In addition, there is no deformation of the supporting portions 2*d* of the coupling portion 2. Thus, as the release projections 2*b* of the coupling portion 2 are pressed inward of the coupling portion 2 in terms of the radius direction of the coupling portion 2 by the sliding of the release ring 4 in the direction indicated by the arrow mark b, the supporting portions 2*d* can easily flex. That is, the hook portions 2*a* flex (displace) inward of the coupling portion 2 in terms of the radius direction of the coupling portion 2, making it possible for the coupling portion 2 to smoothly come out of the hole of the driving ring 3.

Figure 23:
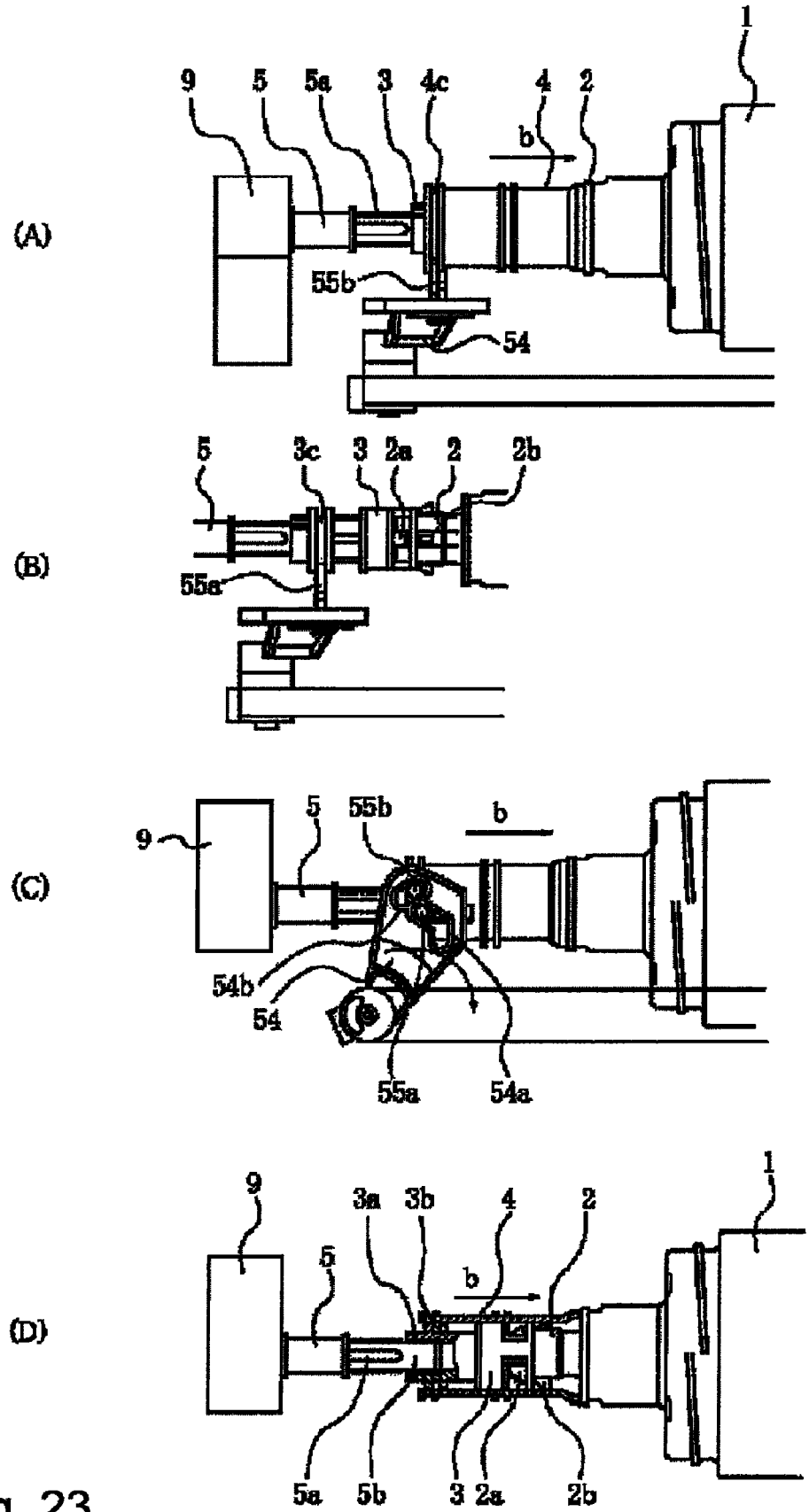
FIG. 23 is a combination of the drawings of the toner releasing end portion of the toner bottle 1, and the toner receiving portion of the image forming apparatus (toner supplying apparatus), showing the operation for taking the toner bottle out.

FIG. 23 shows the joint between the toner bottle 1 and the toner supplying apparatus, in which the lever 11 has just been further rotated from the position shown in FIG. 22. During this rotational movement of the lever 11, only the release ring 4 slides in the direction indicated by the arrow mark b; the driving ring 3 does not move (slide). Thus, the disengagement of the coupling portion 2 (hook portions 2*a*) from the driving ring 3 occurs while there is no rotational friction attributable to the motor 9, between the coupling portion 2 and driving ring 3.

As a result, it becomes possible for the toner bottle 1 to be removed from the bottle tray 50. Thereafter, the user can take the toner bottle 1 out of the toner supplying apparatus by pulling the toner bottle 1 to the position shown in FIG. 24.

To sum up, in this embodiment, the toner bottle 1 is unsealed or resealed by moving the driving ring 3 forward or backward while keeping the toner bottle 1 stationary relative to the bottle tray 50 after the toner bottle 1 is mounted on the bottle tray 50. In other words, the toner bottle 1, which is heavy with toner, does not need to be moved (slid). Thus, this embodiment is smaller in the amount of force necessary to operate the lever 11 than the first and second embodiments.

In the preferred embodiments described above, a user has to rotate the lever 11 to set the toner bottle 1 for toner discharge, or ready the toner bottle 1 for removal. However, these embodiments are not intended to limit the present invention in scope. For example, the present invention is also applicable, with no problem at all, to an image forming apparatus, the toner supplying apparatus of which is provided with a lever or the like which is automatically moved by a motor or the like, instead of the manual lever such as those in the preferred embodiments, so that the above-described sliding movement of the toner bottle 1 and the sliding movements of the other components for setting of the toner bottle 1 for toner delivery, or readying the toner bottle 1 for removal, are automatically carried out.

Also in the preferred embodiments, when connecting the coupling portion 2 with the driving ring 3 to transmit driving force to the coupling portion 2, either the toner bottle 1 (bottle tray 50) or driving ring 3 is slidingly moved. However, these embodiments are not intended to limit the present invention in scope. For example, the present invention is also applicable, with no problem at all, to an image forming apparatus, the toner supplying apparatus of which is structured so that when connecting the coupling portion 2 with the driving ring 3 to transmit driving force to the coupling portion 2, and disconnecting the coupling portion 2 from the driving ring 3 to prevent the driving force from being transmitted to the coupling portion 2, both the toner bottle 1 (bottle tray 50) and driving ring are slidingly moved.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 064249/2008 filed Mar. 13, 2008, which is hereby incorporated by reference.

What is claimed is:

1. A developer supply system comprising:

a developer supply apparatus; and a developer supply container which is detachably mountable to said developer supply apparatus, wherein said developer supply container includes:

a rotatable container body having an inner space configured and positioned to contain a developer;

a feeding portion configured and positioned to feed the developer in said container body to discharge the developer out of said container body with a rotation of said container body; and a hooking portion configured and positioned to engage with said developer supply apparatus to receive a rotational force for rotating said container body, and wherein said developer supply apparatus includes:

a driving member configured and positioned to apply the rotational force;

a drive transmitting member configured and positioned to engage with said hooking portion to transmit the rotational force from said driving member to said hooking portion, said drive transmitting member, which has engaged with said hooking portion, being movable between a first position where said drive transmitting member and said driving member are engaged with each other and a second position where said drive transmitting member and said driving member are not engaged with each other; and a displacing member configured and positioned to displace said hooking portion to release an engagement between said hooking portion and said drive transmitting member which is in the second position.

2. A system according to claim 1, wherein said developer supply apparatus further includes a supporting table configured and positioned to support said developer supply container, and an operating portion for advancing and retracting said supporting table relative to said drive transmitting member, wherein when said developer supply container is set, the advancing and retracting of said supporting table with a rotating operation of said operating portion is effective to engage said hooking portion with said drive transmitting member and to slide said drive transmitting member engaged with said hooking portion from the second position to the first position, and wherein when said developer supply container is dismounted, the advancing and retracting of said supporting table with the rotating operation of said operating portion is effective to slide said drive transmitting member from the first position to the second position and to space from said drive transmitting member in a state of said hooking portion displaced by said displacing member.

3. A system according to claim 1, further comprising an urging member configured and positioned to urge said drive transmitting member from the first position toward the second position.

4. A system according to claim 1, wherein said developer supply container further includes a releasing portion configured and positioned to receive, from said displacing member, a force for displacing said hooking portion at the time of releasing the engagement between said hooking portion and said drive transmitting member.

5. A developer supply apparatus supplied with a developer from a developer supply container including a rotatable container body having an inner space configured and positioned to contain a developer, a feeding portion configured and positioned to feed the developer in said container body to discharge the developer out of said container body with a rotation of said container body, and a hooking portion configured and positioned to engage with said developer supply apparatus to receive a rotational force for rotating said container body, said developer supply apparatus comprising:

a driving member configured and positioned to apply the rotational force;

a drive transmitting member configured and positioned to engage with said hooking portion to transmit the rotational force from said driving member to said hooking portion, said drive transmitting member, which has engaged with said hooking portion, being movable between a first position where said drive transmitting member and said driving member are engaged with each other and a second position where said drive transmitting member and said driving member are not engaged with each other; and a displacing member configured and positioned to displace said hooking portion to release an engagement between said hooking portion and said drive transmitting member which is in the second position.

* * * * *